US008480857B2

(12) United States Patent
Quigley

(10) Patent No.: US 8,480,857 B2
(45) Date of Patent: Jul. 9, 2013

(54) STRUCTURED FABRIC FOR USE IN A PAPERMAKING MACHINE AND THE FIBROUS WEB PRODUCED THEREON

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 124 days.

(21) Appl. No.: 13/019,328

(22) Filed: Feb. 2, 2011

(65) Prior Publication Data

US 2012/0193051 A1 Aug. 2, 2012

(51) Int. Cl.
*D21F 3/00* (2006.01)
*D21F 1/00* (2006.01)
*D03D 25/00* (2006.01)

(52) U.S. Cl.
USPC ..... 162/358.2; 139/383 A

(58) Field of Classification Search
USPC ..... 162/358.2; 139/383 A
See application file for complete search history.

(56) References Cited

U.S. PATENT DOCUMENTS 5,254,398 A * 10/1993 Gaisser ..... 442/195
5,429,686 A 7/1995 Chiu et al.
6,237,644 B1 5/2001 Hay et al.
7,585,395 B2 9/2009 Quigley et al.
2009/0065167 A1* 3/2009 Quigley ..... 162/348
2011/0036527 A1* 2/2011 Ward ..... 162/289

FOREIGN PATENT DOCUMENTS

EP 1837439 A2 9/2007
WO 2005075732 A2 8/2005
WO 2005075736 A2 8/2005

* cited by examiner

*Primary Examiner* — Jacob Thomas Minskey
(74) *Attorney, Agent, or Firm* — Taylor IP, P.C.

(57) ABSTRACT

A papermaking machine for the production of a fibrous web. The papermaking machine including a plurality of rollers and a structured fabric moving along the plurality of rollers. The structured fabric includes a plurality of weft yarns and a plurality of warp yarns woven with the plurality of weft yarns to produce a weave pattern. The plurality of warp yarns are a plurality of paired warp yarn sets, each paired warp yarn set including a first warp yarn and a second warp yarn. Within the weave pattern the first warp yarn weaves a plain weave while the second warp yarn floats over a first portion of the plurality of weft yarns. The second warp yarn weaving a plain weave while the first warp yarn floats over a second portion of the plurality of weft yarns in the weave pattern.

18 Claims, 27 Drawing Sheets

28

38

28

38

28

38

28

38

STRUCTURED FABRIC FOR USE IN A PAPERMAKING MACHINE AND THE FIBROUS WEB PRODUCED THEREON

BACKGROUND OF THE INVENTION

1. Field of the Invention

The present invention relates generally to papermaking, and relates more specifically to a structured fabric employed in a papermaking machine for the production of a fibrous web.

2. Description of the Related Art

In a conventional papermaking process, a water slurry, or suspension, of cellulosic fibers (known as the paper "stock") is fed into a gap between two endless woven wires that travels between two or more rolls. At least one of the wires are often referred to as a "structured fabric" that provides a papermaking surface on the upper surface of its upper run which operates as a filter to separate the cellulosic fibers of the paper stock from the aqueous medium, thereby forming a wet paper web. The aqueous medium drains through mesh openings of the structured fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermakers' fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermakers' fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the structured fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and the like) the papermaking surface comprises a very finely woven or fine wire mesh structure.

In a conventional tissue forming machine, the sheet is formed flat. At the press section, 100% of the sheet is pressed and compacted to reach the necessary dryness and the sheet is further dried on a Yankee and hood section. The sheet is then creped and wound-up, thereby producing a flat sheet.

In an ATMOS™ system, a sheet is formed on a structured or molding fabric and the sheet is further sandwiched between the structured or molding fabric and a dewatering fabric. The sheet is dewatered through the dewatering fabric and opposite the molding fabric. The dewatering takes place with airflow and mechanical pressure. The mechanical pressure is created by a permeable belt and the direction of air flow is from the permeable belt to the dewatering fabric. This can occur when the sandwich passes through an extended pressure nip formed by a vacuum roll and the permeable belt. The sheet is then transferred to a Yankee by a press nip. Only about 25% of the sheet is slightly pressed by the Yankee while approximately 75% of the sheet remains unpressed for quality. The sheet is dried by a Yankee/Hood dryer arrangement and then dry creped. In the ATMOS™ system, one and the same structured fabric is used to carry the sheet from the headbox to the Yankee dryer. Using the ATMOS™ system, the sheet reaches between about 35 to 38% dryness after the ATMOS™ roll, which is almost the same dryness as a conventional press section. However, this advantageously occurs with almost 40 times lower nip pressure and without compacting and destroying sheet quality. Furthermore, a big advantage of the ATMOS™ system is that it utilizes a permeable belt which is highly tensioned, e.g., about 60 kN/m. This belt enhances the contact points and intimacy for maximum vacuum dewatering. Additionally, the belt nip is more than 20 times longer than a conventional press and utilizes airflow through the nip, which is not the case on a conventional press system.

Actual results from trials using an ATMOS™ system have shown that the caliper and bulk of the sheet is 30% higher than the conventional through-air drying (TAD) formed towel fabrics. Absorbency capacity is also 30% higher than with conventional TAD formed towel fabrics. The results are the same whether one uses 100% virgin pulp up to 100% recycled pulp. Sheets can be produced with basis weight ratios of between 14 to 40 g/m$^2$. The ATMOS™ system also provides excellent sheet transfer to the Yankee working at 33 to 37% dryness. A key aspect of the ATMOS™ system is that it forms the sheet on the molding fabric and the same molding fabric carries the sheet from the headbox to the Yankee dryer. This produces a sheet with a uniform and defined pore size for maximum absorbency capacity.

U.S. patent application Ser. No. 11/753,435 filed on May 24, 2007, the disclosure of which is hereby expressly incorporated by reference in its entirety, discloses a structured fabric for an ATMOS™ system. The fabric utilizes an at least three float warp and weft structure which, like the prior art fabrics, is symmetrical in form.

U.S. Pat. No. 5,429,686 to CHIU et al., the disclosure of which is hereby expressly incorporated by reference in its entirety, discloses structured forming fabrics which utilize a load-bearing layer and a sculptured layer. The fabrics utilize impression knuckles to imprint the sheet and increase its surface contour. This document, however, does not create pillows in the sheet for effective dewatering of TAD applications, nor does it teach using the disclosed fabrics on an ATMOS™ system and/or forming the pillows in the sheet while the sheet is relatively wet and utilizing a hi-tension press nip.

What is needed in the art is an efficient effective single layer fabric weave pattern to be used in a papermaking machine.

SUMMARY OF THE INVENTION

In one aspect, the invention provides a papermaking machine for the production of a fibrous web. The papermaking machine including a plurality of rollers and a structured fabric moving along the plurality of rollers. The structured fabric includes a plurality of weft yarns and a plurality of warp yarns woven with the plurality of weft yarns to produce a weave pattern. The plurality of warp yarns are a plurality of paired warp yarn sets, each paired warp yarn set including a first warp yarn and a second warp yarn. Within the weave pattern the first warp yarn weaves a plain weave while the second warp yarn floats over a first portion of the plurality of weft yarns. The second warp yarn weaving a plain weave while the first warp yarn floats over a second portion of the plurality of weft yarns in the weave pattern.

In another aspect, the invention is a structured fabric for use in a papermaking machine to produce a fibrous web. The structured fabric includes a plurality of weft yarns and a plurality of warp yarns woven with the plurality of weft yarns to produce a weave pattern. The plurality of warp yarns are a plurality of paired warp yarn sets, each paired warp yarn set including a first warp yarn and a second warp yarn. Within the weave pattern the first warp yarn weaves a plain weave while the second warp yarn floats over a first portion of the plurality of weft yarns. The second warp yarn weaving a plain weave while the first warp yarn floats over a second portion of the plurality of weft yarns in the weave pattern.

In yet another aspect the invention provides a fibrous web having a fibrous construct with at least one formed surface feature. The surface feature includes a topographical pattern reflective of a weave pattern in a structured fabric used in a papermaking machine, the structured fabric having a machine facing side and a web facing side. The structured fabric includes a plurality of weft yarns and a plurality of warp yarns woven with the plurality of weft yarns to produce a weave pattern. The plurality of warp yarns are a plurality of paired warp yarn sets, each paired warp yarn set including a first warp yarn and a second warp yarn. Within the weave pattern the first warp yarn weaves a plain weave while the second warp yarn floats over a first portion of the plurality of weft yarns. The second warp yarn weaving a plain weave while the first warp yarn floats over a second portion of the plurality of weft yarns in the weave pattern.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, and the description is taken with the drawings making apparent to those skilled in the art how the forms of the present invention may be embodied in practice.

The present invention relates to a structured fabric for a papermaking machine, a former for manufacturing a paper web, and also to a former which utilizes the structured fabric, and in some embodiments a belt press, in a papermaking machine.

The present invention also relates to a twin wire former ATMOS™ system which utilizes the structured fabric which has good resistance to pressure and excessive tensile strain forces, and which can withstand wear/hydrolysis effects that are experienced in an ATMOS™ system. The system may also include a permeable belt for use in a high tension extended nip around a rotating roll or a stationary shoe and a dewatering fabric for the manufacture of premium tissue or towel grades. The fabric has key parameters which include permeability, weight, caliper, and certain compressibility.

Figure 1:
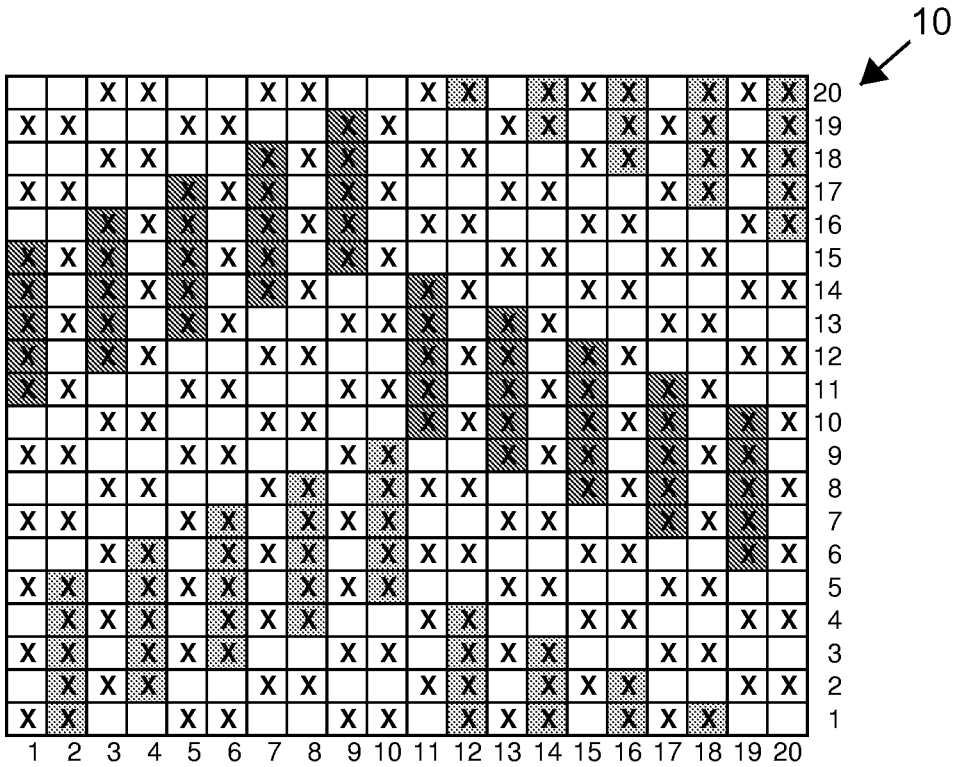
FIG. 1 shows a repeating weave pattern from the top side, or web facing side, of an embodiment of a structured fabric of the present invention, each 'X' indicating a location where a warp yarn passes over a weft yarn.

Weave patterns 10 of the structured fabric 28 of the present invention are illustrated in FIGS. 1-40. FIG. 1 depicts a weave pattern 10 from a top pattern view of the web facing side of the fabric, also known as the papermaking surface. The numbers 1-20, shown on the bottom of the pattern identify the warp, machine direction (MD) yarns, while the right side numbers 1-20 show the weft, cross direction (CD) yarns. The symbol 'X' illustrates a location where a warp yarn passes over a weft yarn and an empty box illustrates a location where a warp yarn passes under a weft yarn. As shown in FIG. 1, the areas that are shaded generally indicate long float warp yarns, which float over at least two weft yarns. Sometimes the shaded area is just one box and that helps denote the pattern being formed in structured fabric 28. The shaded areas form an MD float pattern, while the non-shaded areas represent a plain weave pattern for the warp yarns. The different levels of shading only denote patterns that may be visually associated and do not denote a different kind of float. In a like manner, the weave patterns of FIGS. 6, 11, 16, 21, 26, 31 and 36 illustrate other embodiments of the present invention in the same format, each being conveniently identified with reference number 10.

Figure 2:
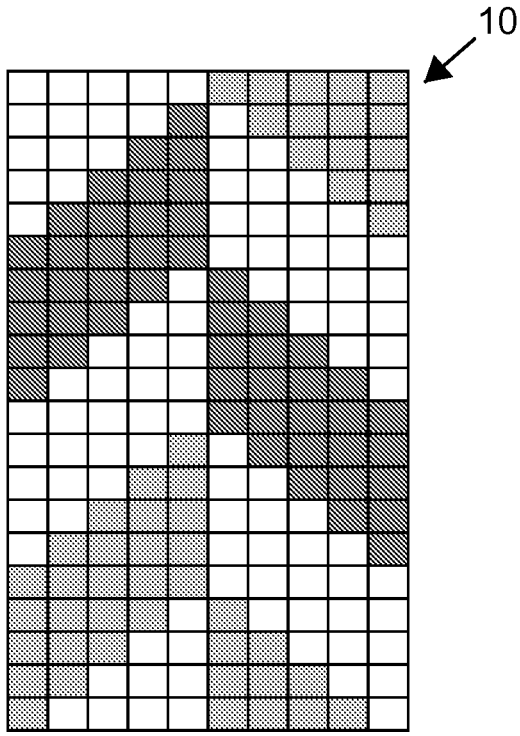
FIG. 2 illustrates a surface motif of the weave pattern of FIG. 1.

While a warp yarn floats over weft yarns each adjacent warp yarn weaves plainly with the weft yarns resulting in a physical motif that is illustrated in FIG. 2. Corresponding FIGS. 7, 12, 17, 22, 27, 32 and 37 for the other embodiments also show motifs for those respective embodiments. Periodically some of the long floats may be interrupted with a single weave of a weft yarn. The floats predominate over the plain weaving portions of the adjacent warp yarns such that the surface web facing side of structured fabric 28 substantially reflects the motif of the above noted Figs.

It should be noted that although long floats have been described as perhaps being interrupted with one or even two separate single weaves with a weft yarn, it is equally accurate to look at a float that is interrupted as being multiple floats (without interruption) and the discussion herein is equally applicable with these multiple floats adhering to the same rules of plain weaving adjacent to floating warp yarns and adjacent float offsets in one direction or the other as described hereinafter.

Figure 3:
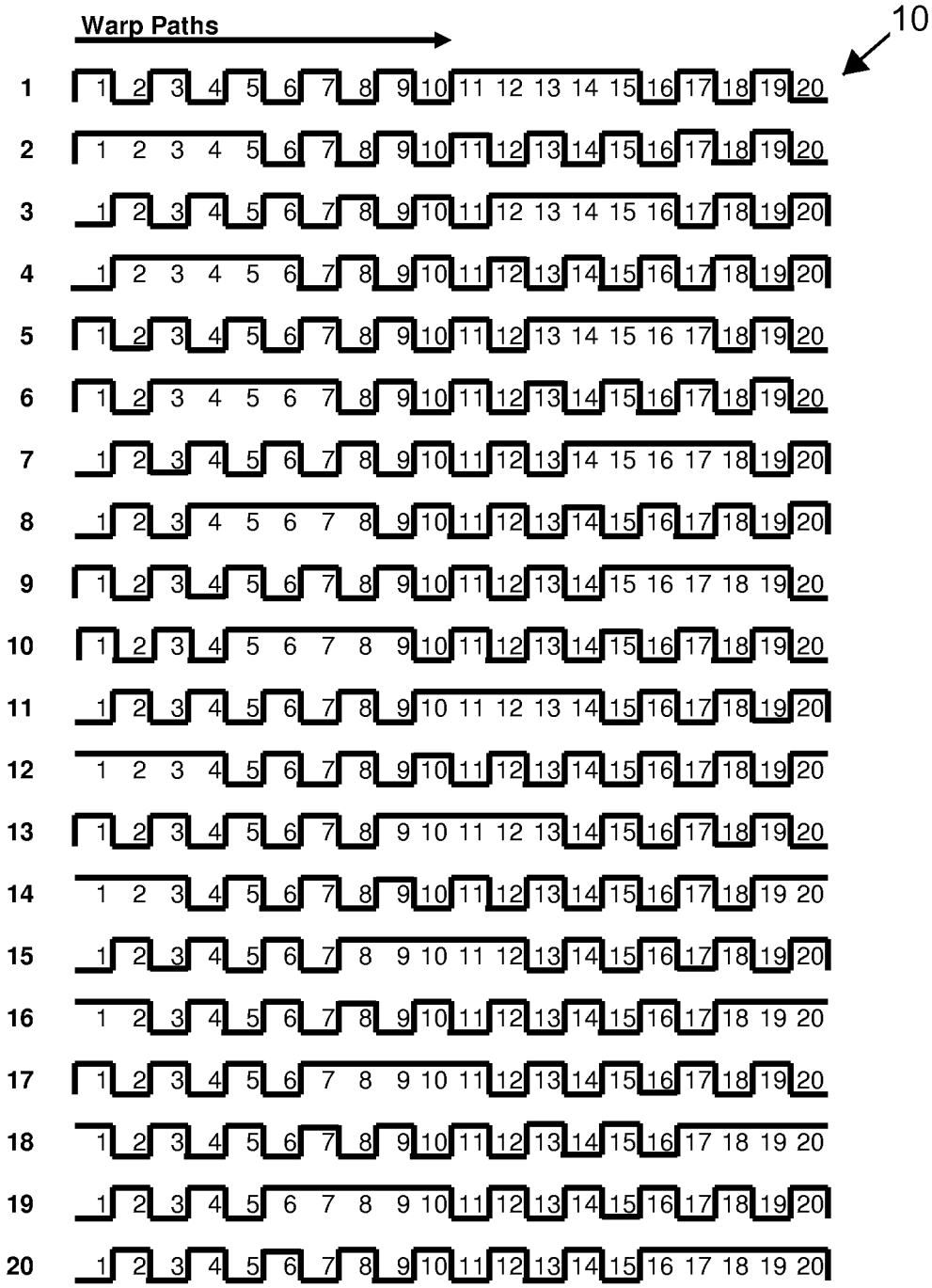
FIG. 3 shows the repeating weave pattern of the warp yarns of the embodiment of FIGS. 1 and 2.

FIG. 3 illustrates the weave pattern of the warp yarns relative to the weft yarns with the weft yarns being represented in each line as the numbers and with the line being the pattern of the warp yarns. Each line represents the warp yarn identified along the left side of the Fig. In a like manner, FIGS. 8, 13, 18, 23, 28, 33 and 38 represent the weave patterns of each respective embodiment.

Figure 4:
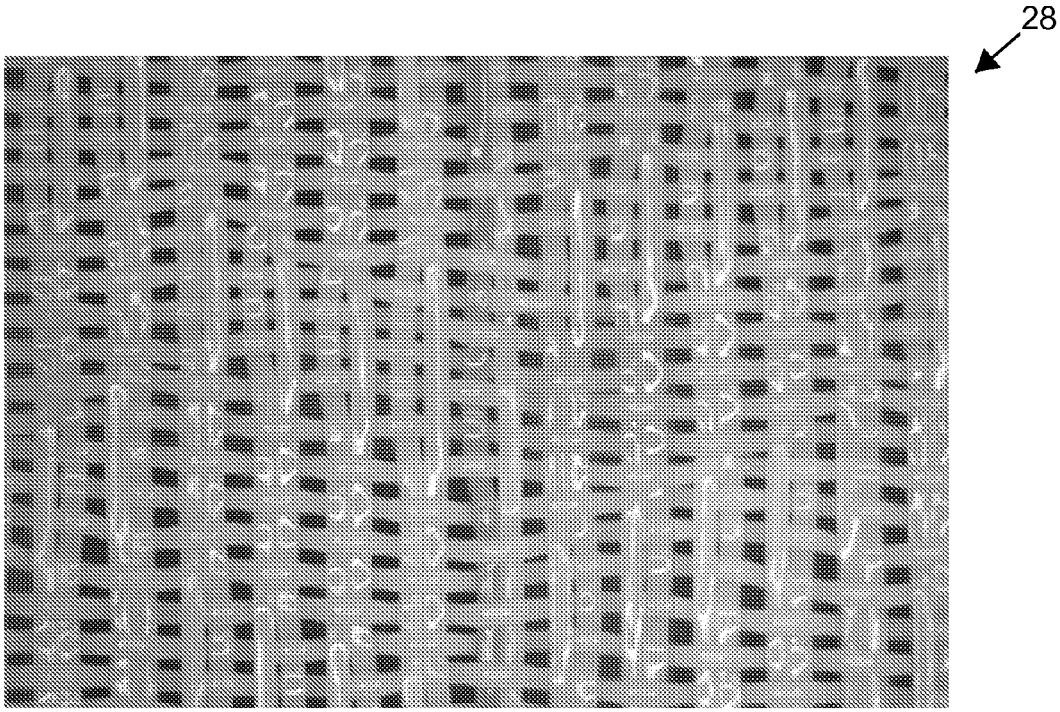
FIG. 4 is an illustration of the structured fabric that results from the weave pattern of FIGS. 1-3.

Referring now to FIG. 4 there is an illustration of what the weave pattern of this set of embodiments produce within structured fabric 28. In a like manner, FIGS. 9, 14, 19, 24, 29, 34 and 39 illustrate structured fabrics 28 of each separate embodiment.

Figure 5:
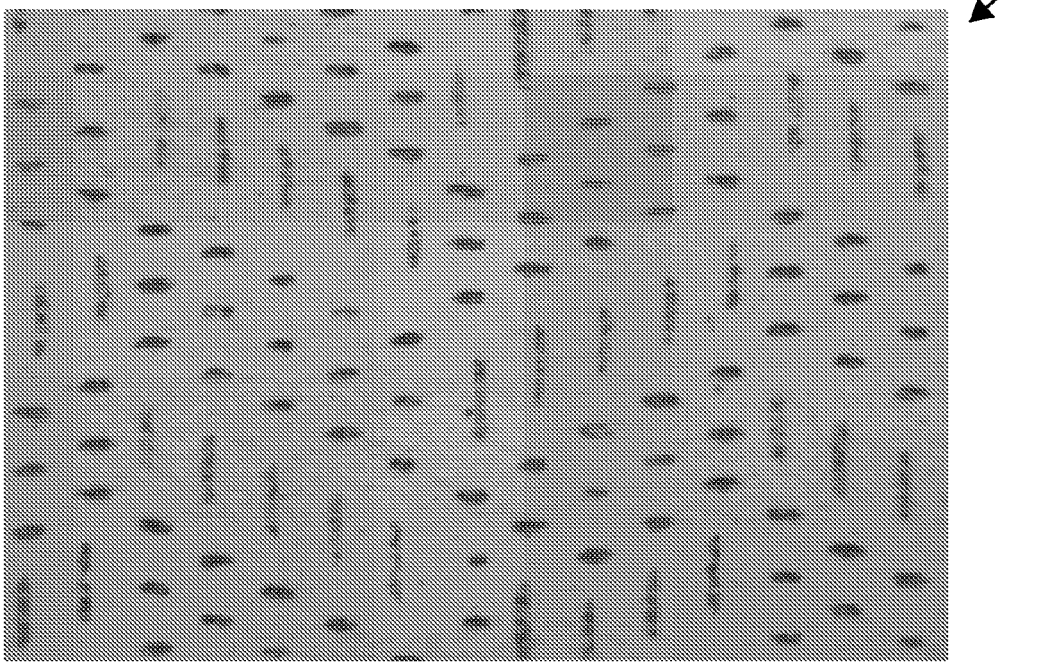
FIG. 5 is an illustration of the impression the structured fabric of FIG. 4 makes on a web.
Figure 6:
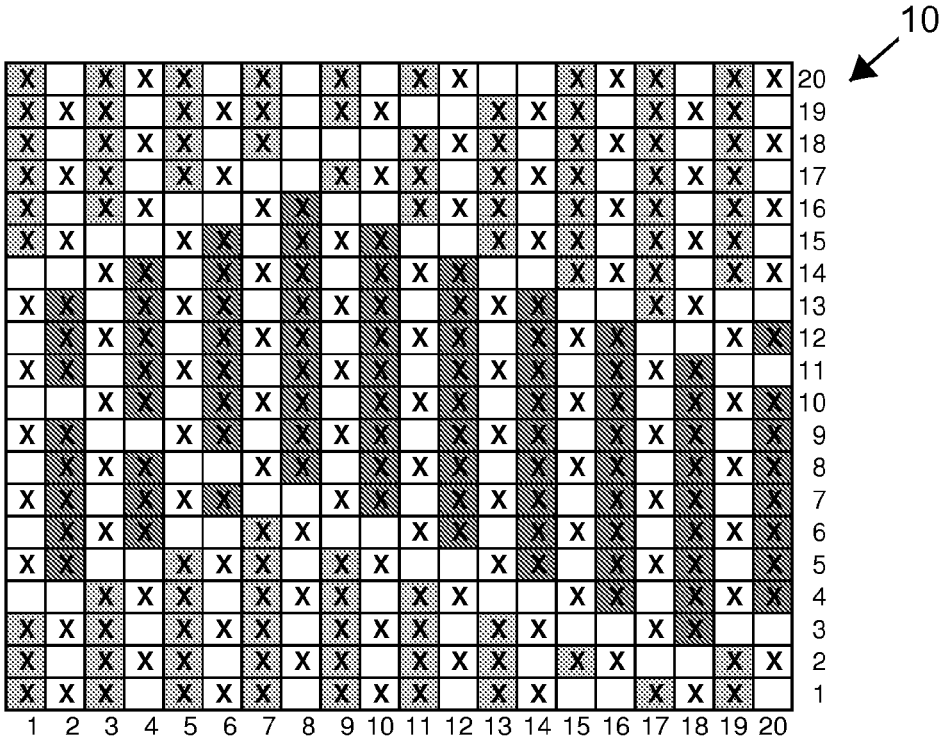
FIG. 6 shows a repeating weave pattern from the top side, or paper facing side, of another embodiment of a structured fabric of the present invention, each 'X' indicating a location where a warp yarn passes over a weft yarn.
Figure 7:
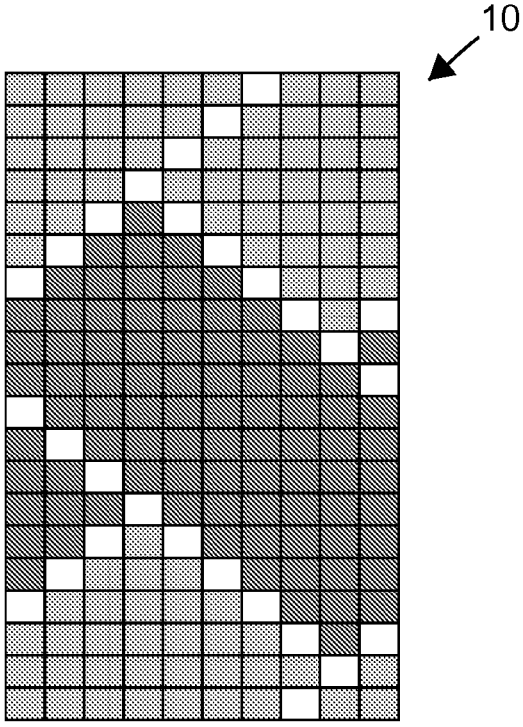
FIG. 7 illustrates a surface motif of the weave pattern of FIG. 6.
Figure 8:
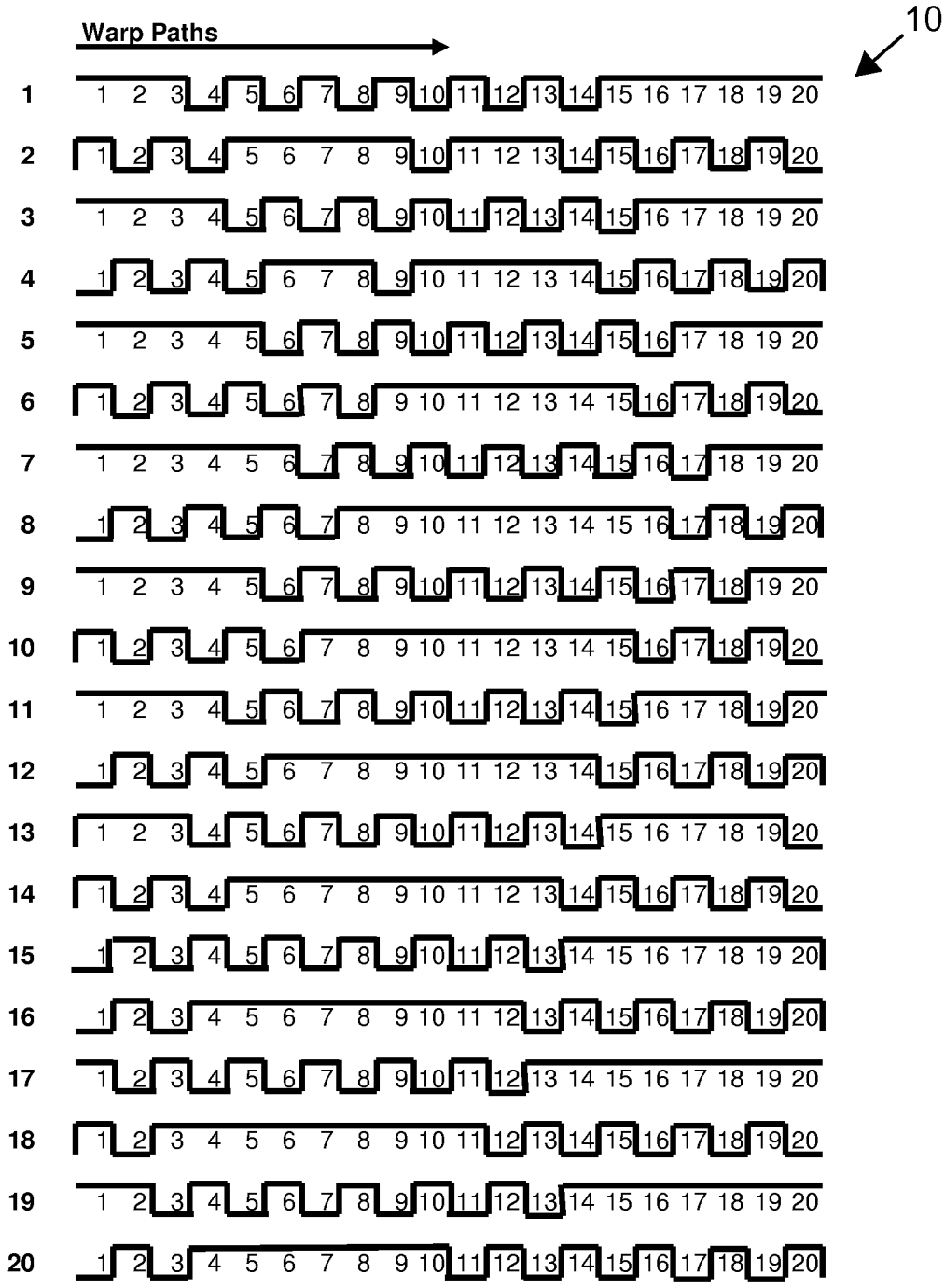
FIG. 8 shows the repeating weave pattern of the warp yarns of the embodiment of FIGS. 6 and 7.
Figure 9:
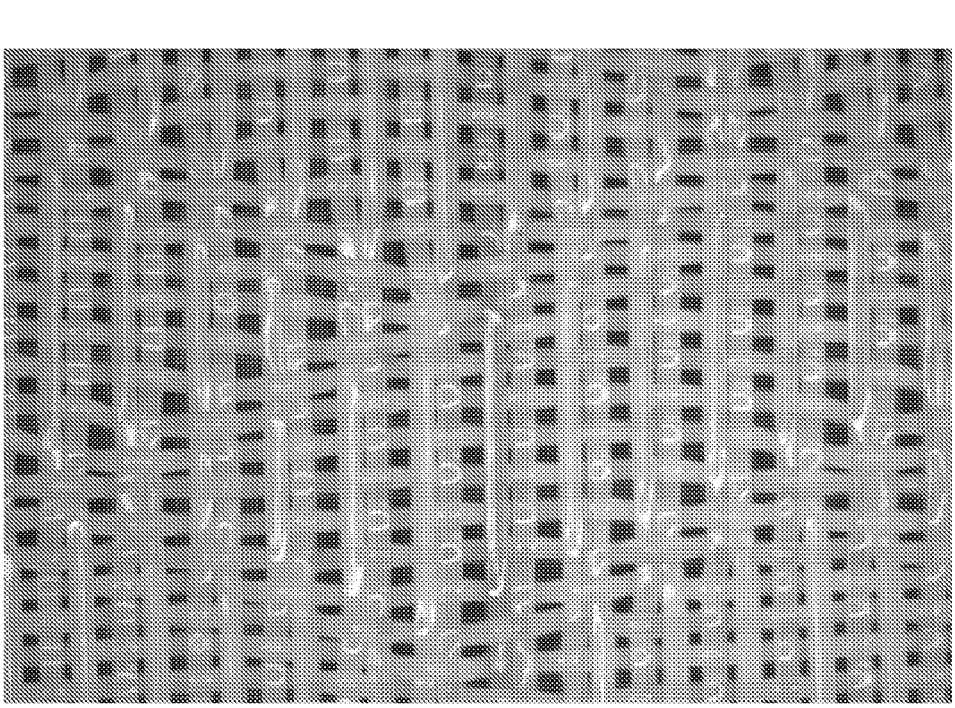
FIG. 9 is an illustration of the structured fabric that results from the weave pattern of FIGS. 6-8.
Figure 10:
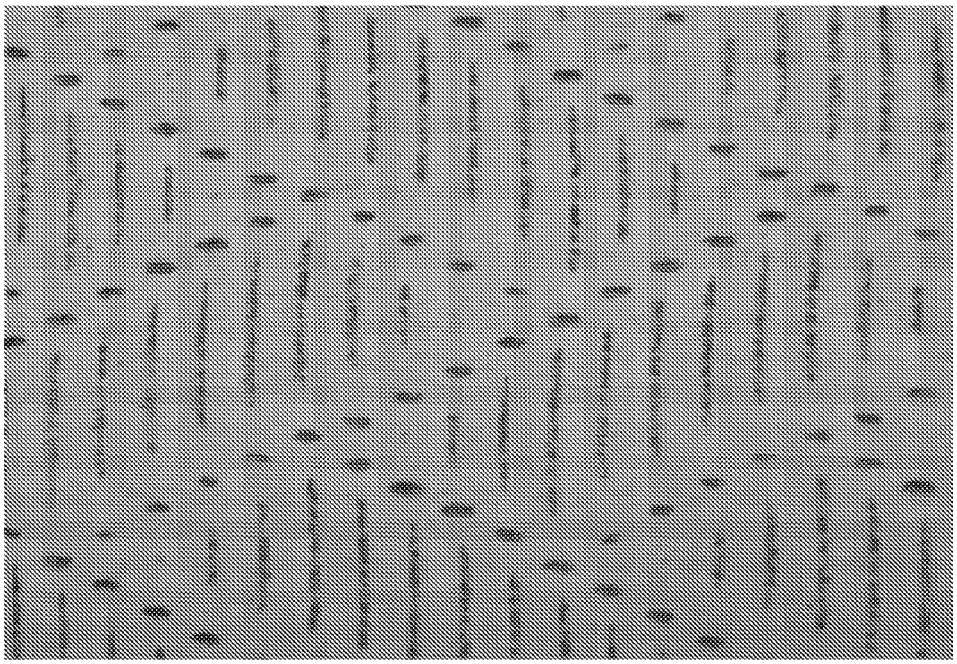
FIG. 10 is an illustration of the impression the structured fabric of FIG. 9 makes on a web.
Figure 11:
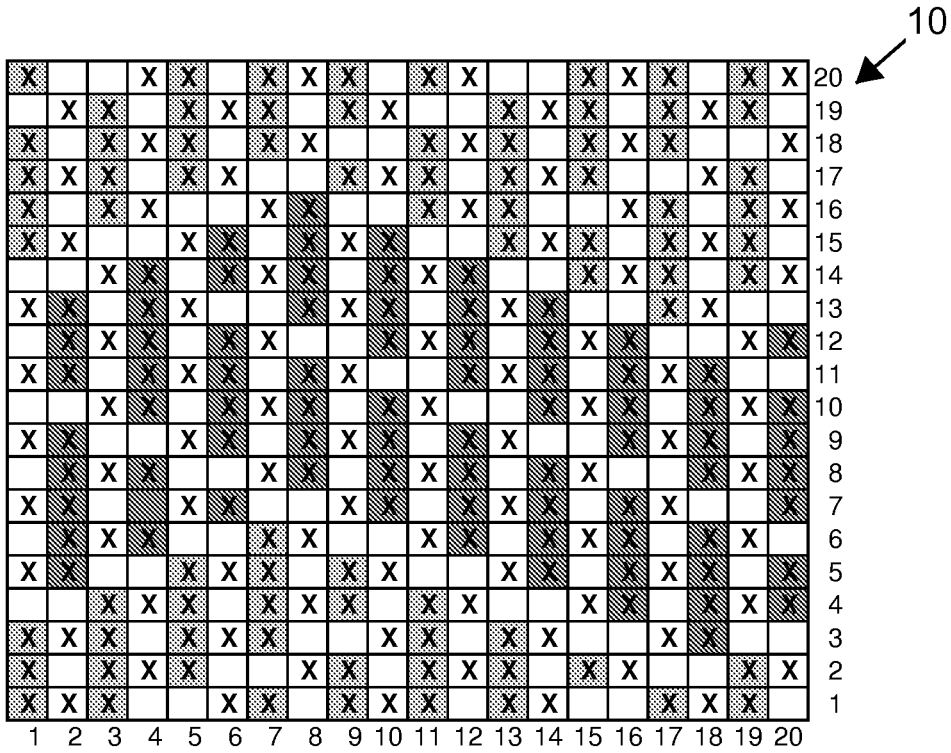
FIG. 11 shows a repeating weave pattern from the top side, or paper facing side, of an yet another embodiment of a structured fabric of the present invention, each 'X' indicating a location where a warp yarn passes over a weft yarn.
Figure 12:
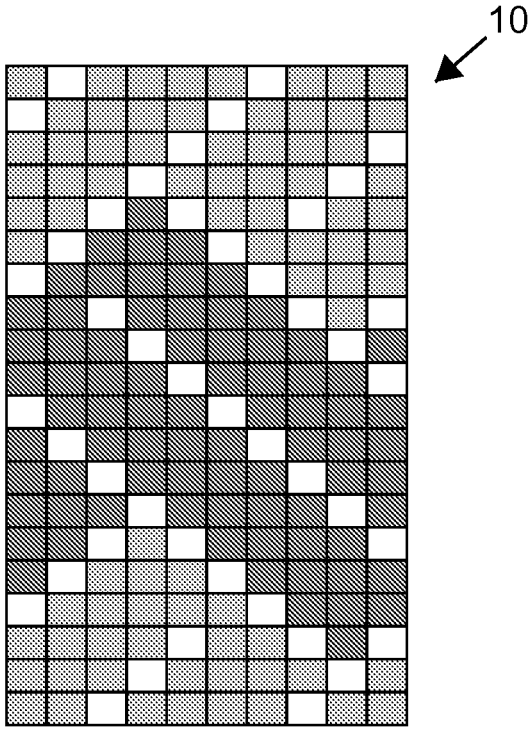
FIG. 12 illustrates a surface motif of the weave pattern of FIG. 11.
Figure 13:
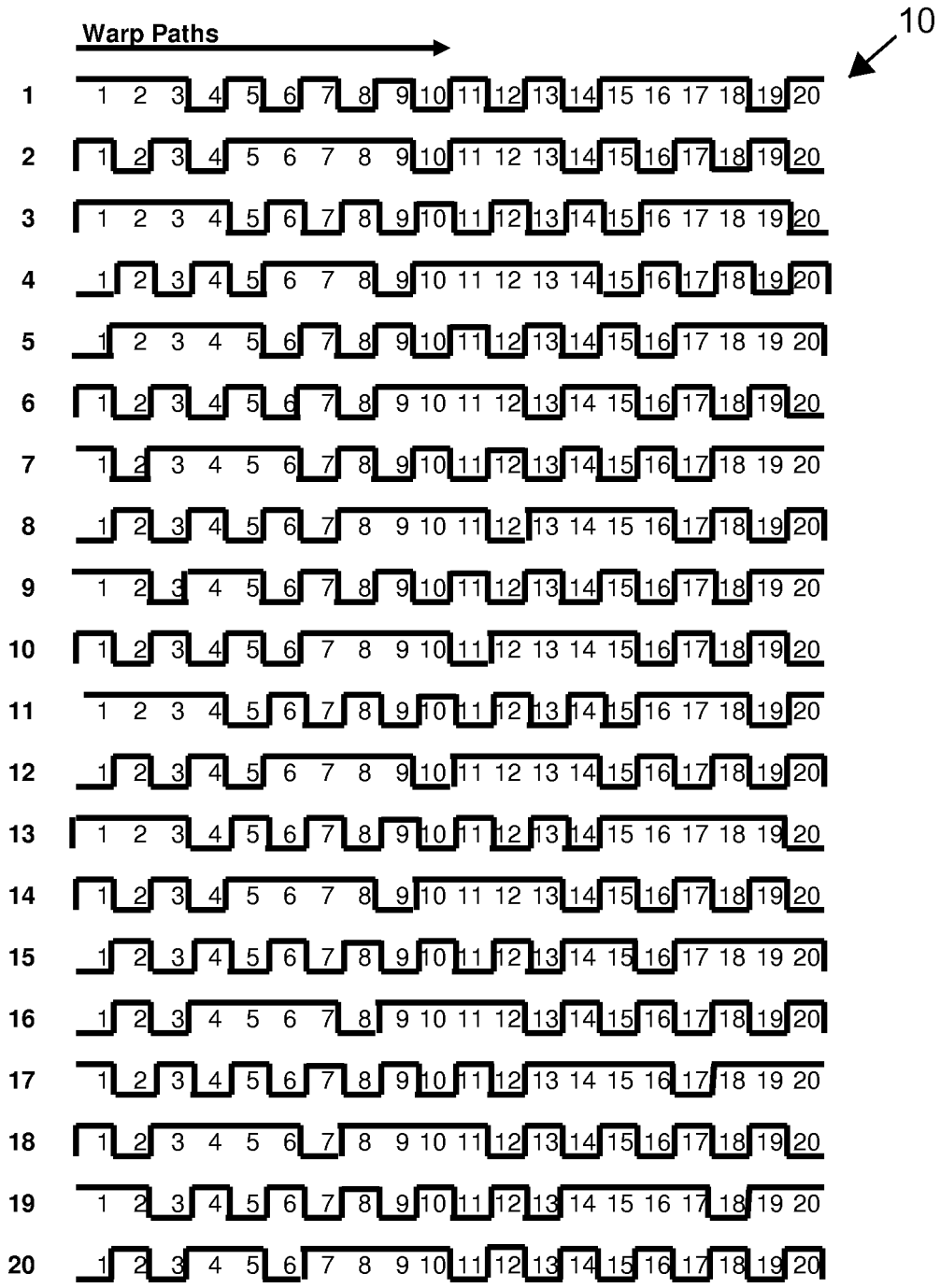
FIG. 13 shows the repeating weave pattern of the warp yarns of the embodiment of FIGS. 11 and 12.
Figure 14:
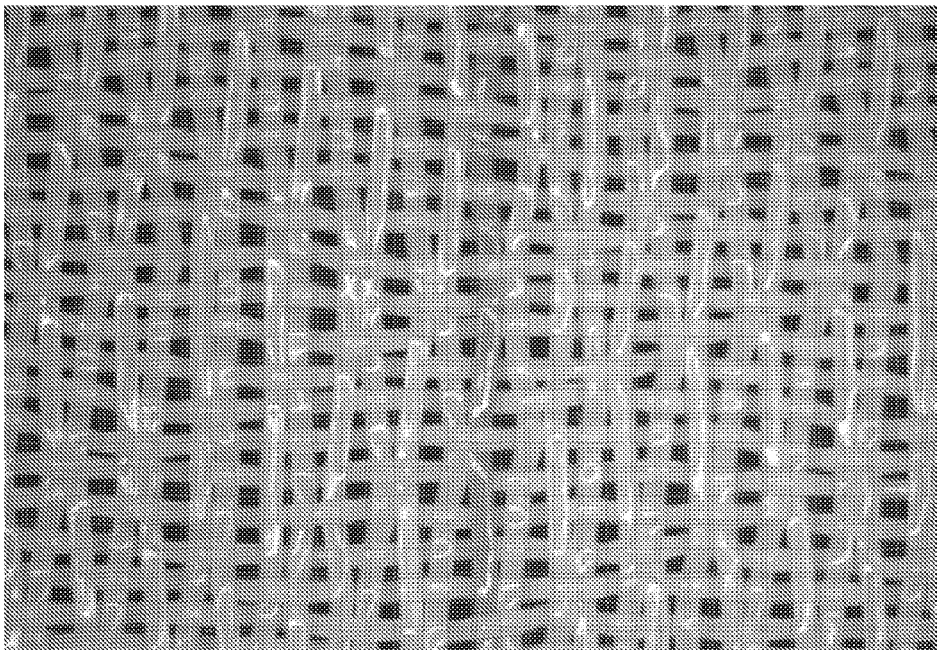
FIG. 14 is an illustration of the structured fabric that results from the weave pattern of FIGS. 11-13.
Figure 15:
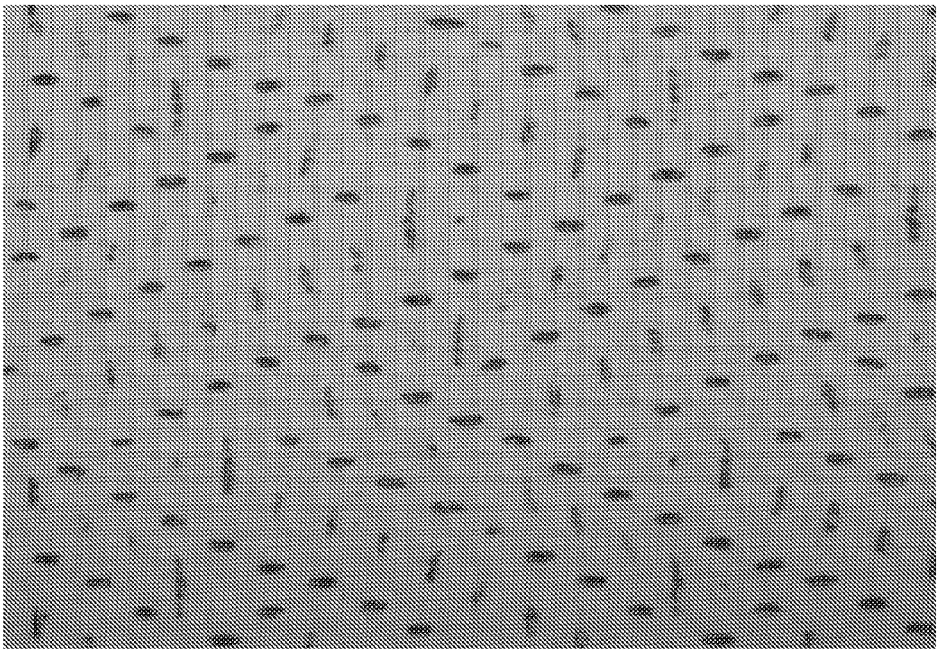
FIG. 15 is an illustration of the impression the structured fabric of FIG. 14 makes on a web.
Figure 16:
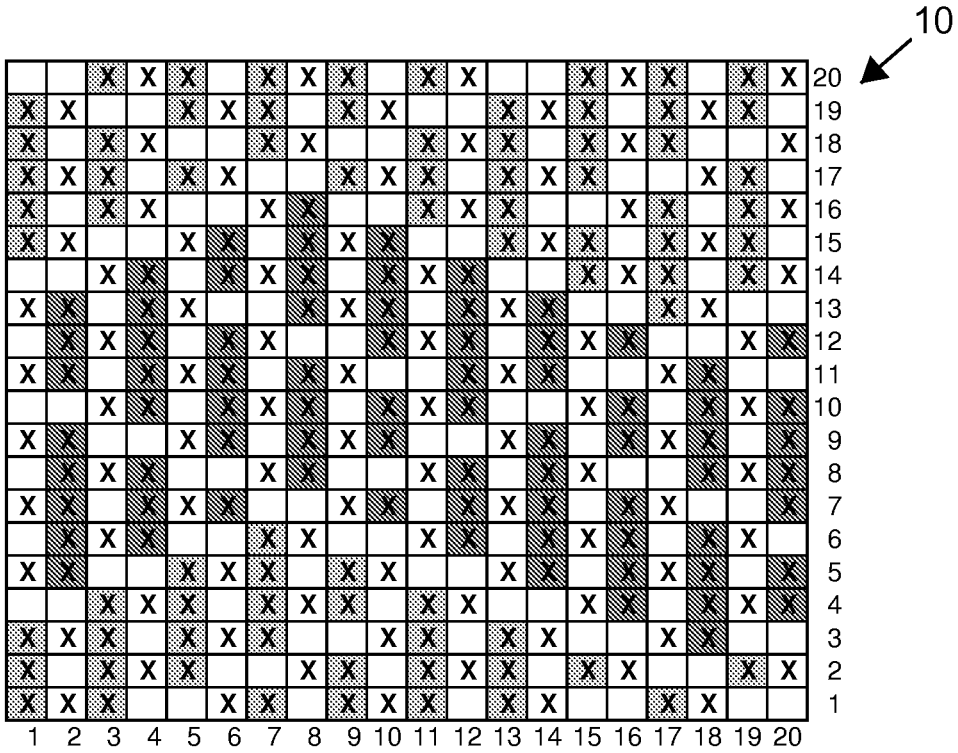
FIG. 16 shows a repeating weave pattern from the top side, or paper facing side, of an yet still another embodiment of a structured fabric of the present invention, each 'X' indicating a location where a warp yarn passes over a weft yarn.
Figure 17:
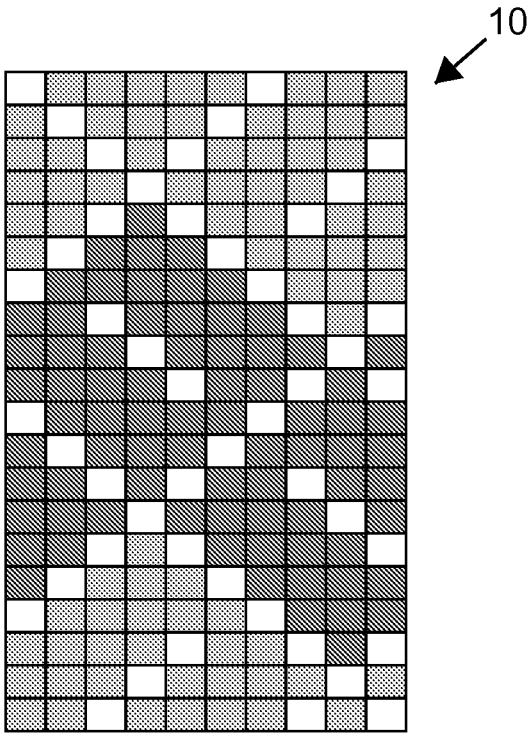
FIG. 17 illustrates a surface motif of the weave pattern of FIG. 16.
Figure 18:
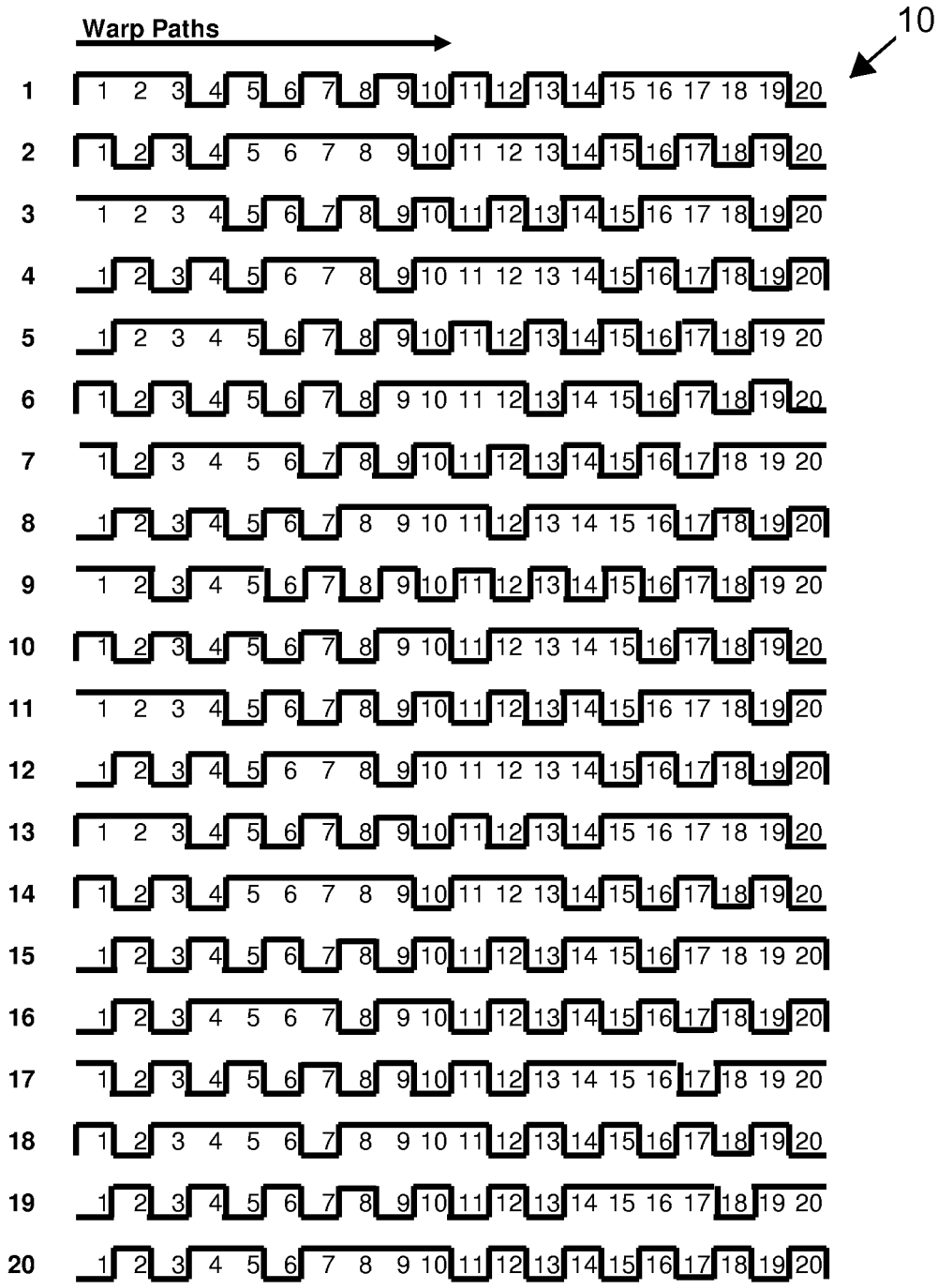
FIG. 18 shows the repeating weave pattern of the warp yarns of the embodiment of FIGS. 16 and 17.
Figure 19:
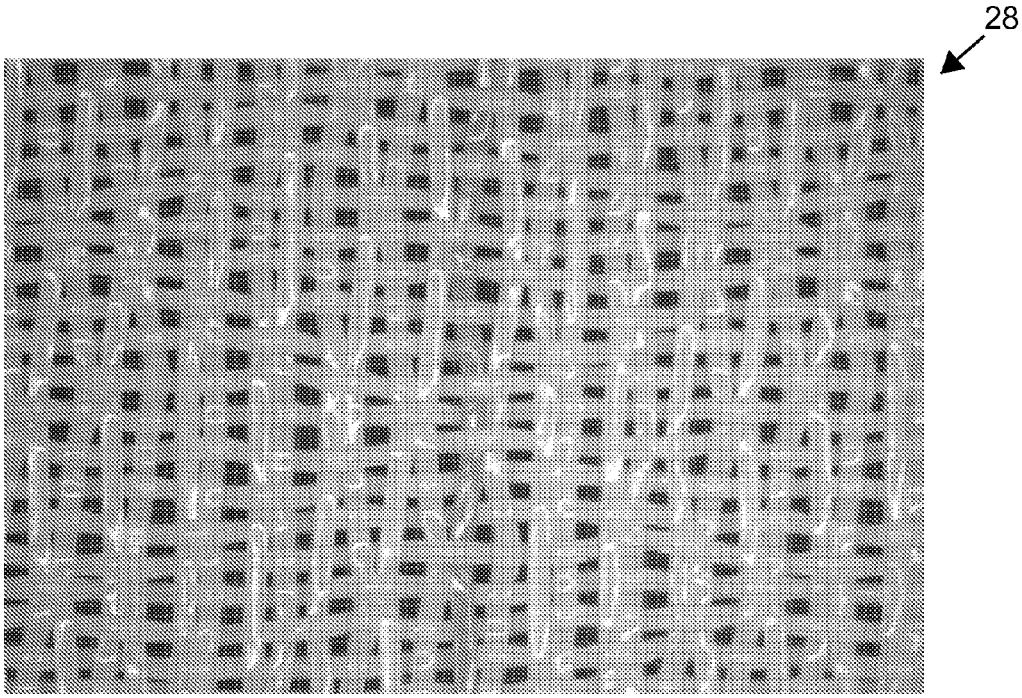
FIG. 19 is an illustration of the structured fabric that results from the weave pattern of FIGS. 16-18.
Figure 20:
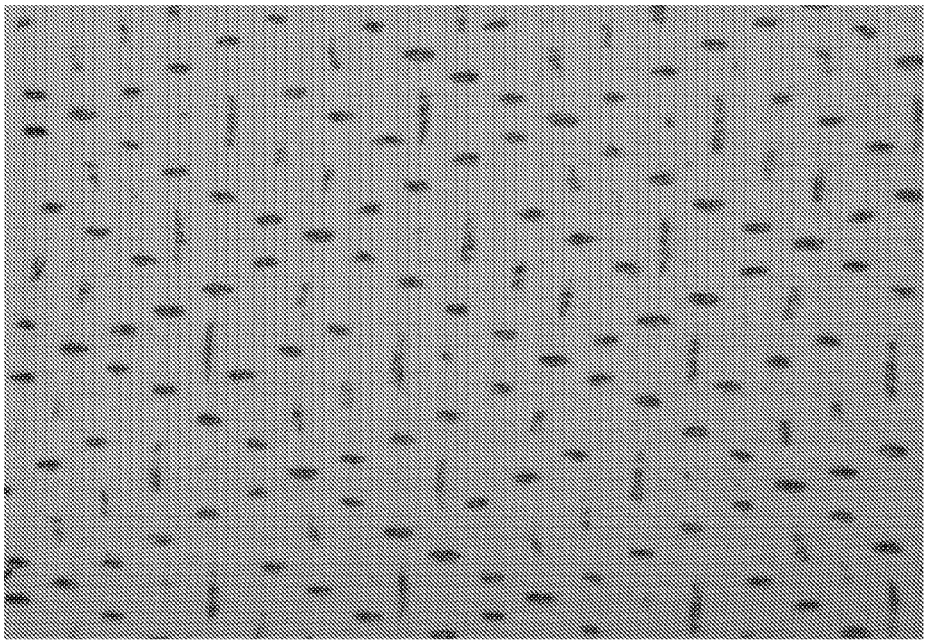
FIG. 20 is an illustration of the impression the structured fabric of FIG. 19 makes on a web.
Figure 21:
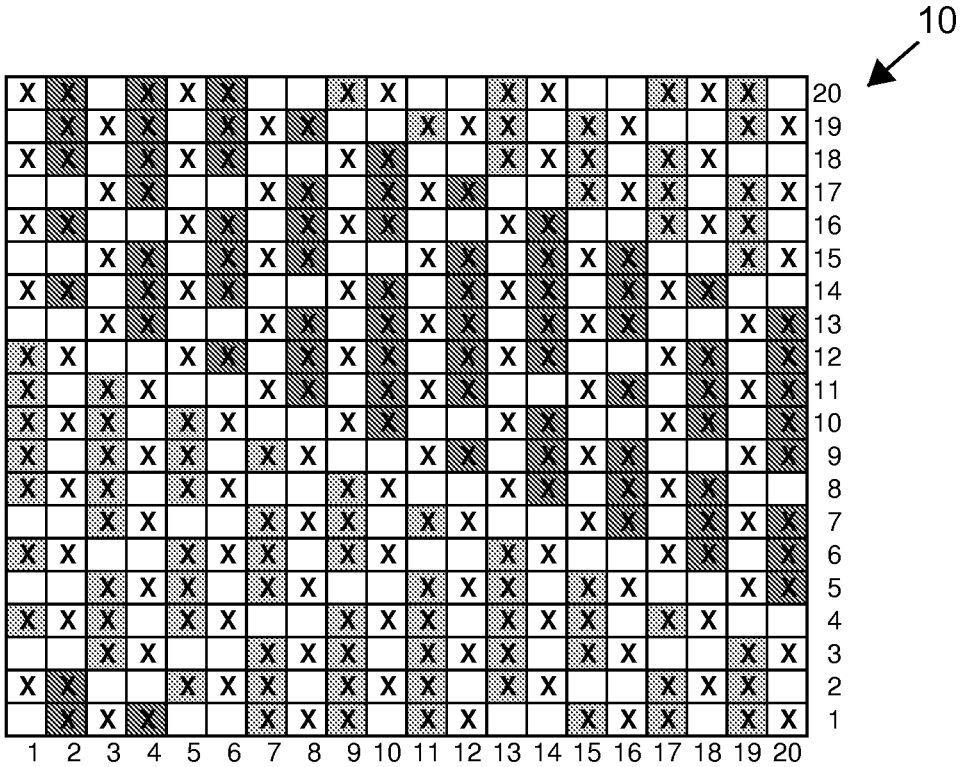
FIG. 21 shows a repeating weave pattern from the top side, or paper facing side, of a further embodiment of a structured fabric of the present invention, each 'X' indicating a location where a warp yarn passes over a weft yarn.
Figure 22:
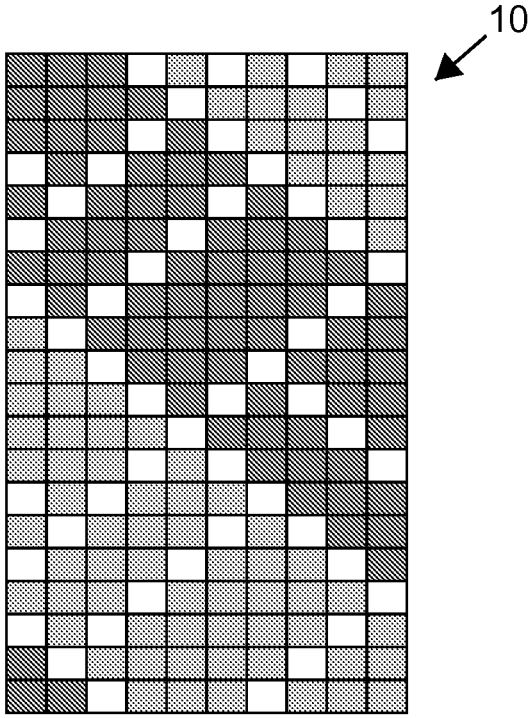
FIG. 22 illustrates a surface motif of the weave pattern of FIG. 21.
Figure 23:
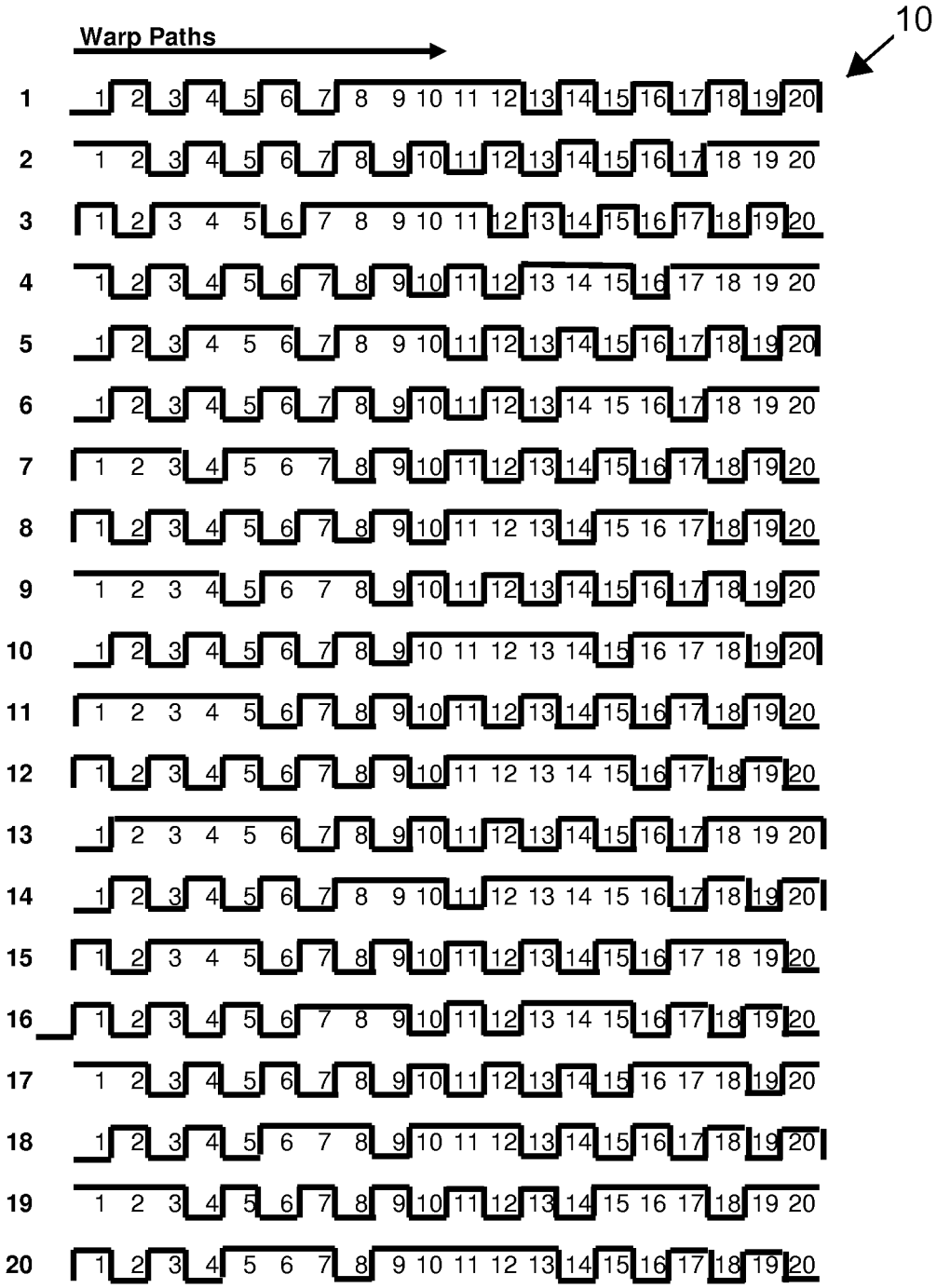
FIG. 23 shows the repeating weave pattern of the warp yarns of the embodiment of FIGS. 21 and 22.
Figure 24:
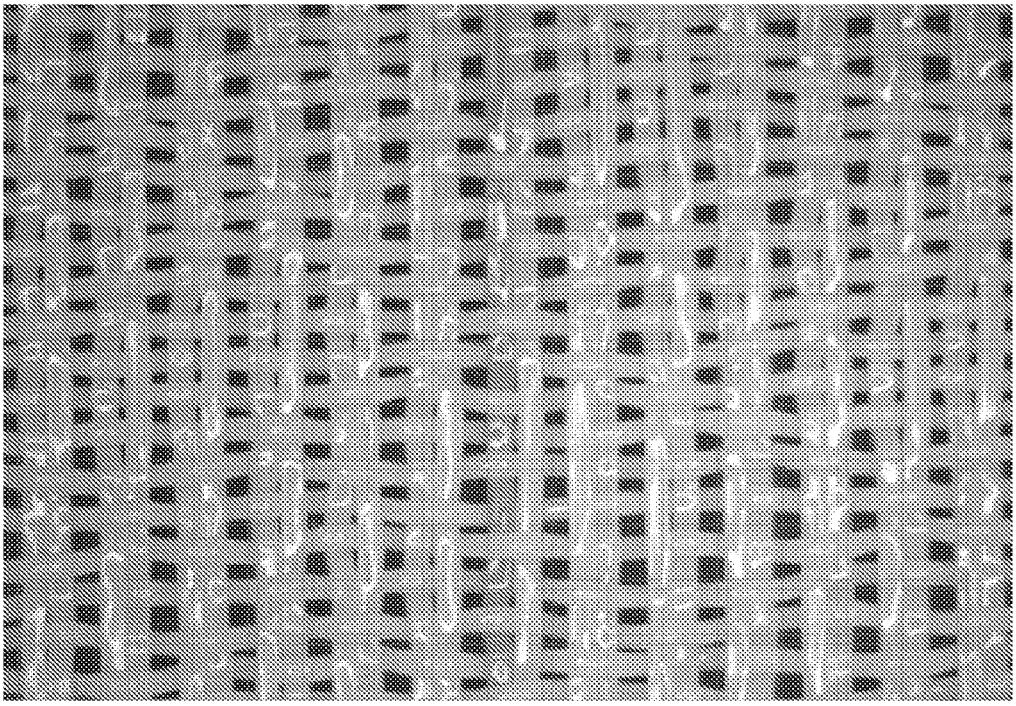
FIG. 24 is an illustration of the structured fabric that results from the weave pattern of FIGS. 21-23.
Figure 25:
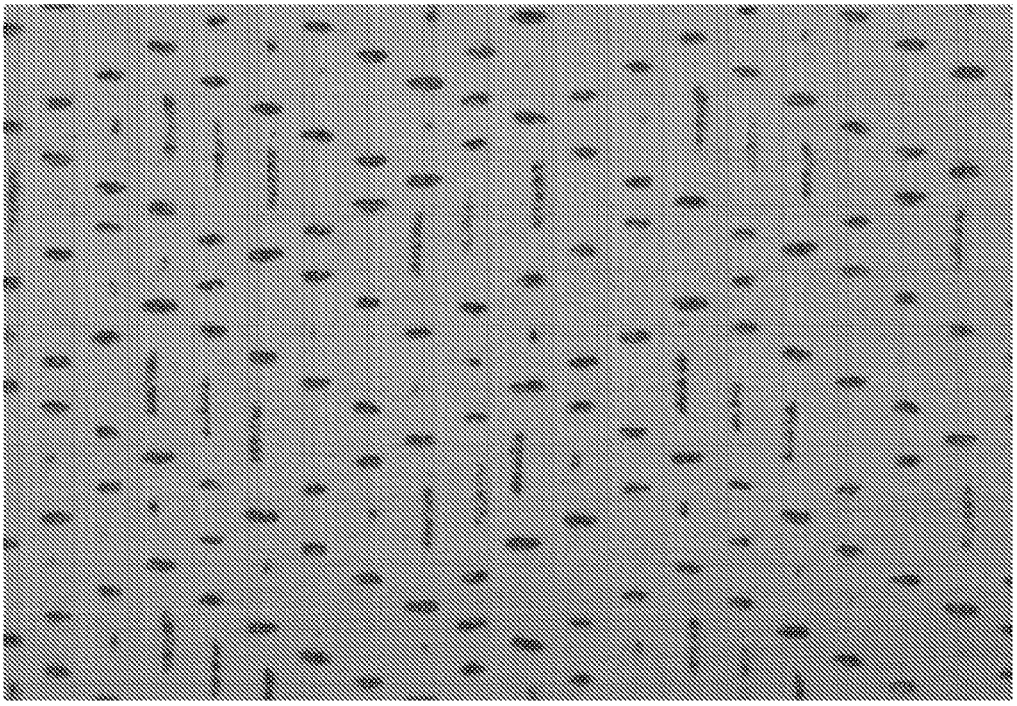
FIG. 25 is an illustration of the impression the structured fabric of FIG. 24 makes on a web.

Now, additionally referring to FIG. 5, there is illustrated the impression of fabric 28 on paper or web 38. This impression illustrates where web 38 is most largely impressed with structured fabric 28 and reflects the motif associated with each embodiment. In a like manner, FIGS. 5, 10, 15, 20, 25, 30, 35 and 40 also are illustrative of the impression of each structured fabric 28, respective to each embodiment.

Topographical features of weave pattern 10 are repeated in structured fabric 28 and are reflected upon web 38 as web 38 is produced in the papermaking machine. The topographical features cause a three-dimensional effect in web 38 reflective of weave pattern 10, which enhances web 38 and imparts characteristics to web 38, such as pocket depth and texture.

The warp yarns interact with the weft yarns to produce weave patterns 10. Each set of two warp yarns can be thought of as a paired warp yarn set with one of the yarns only plain weaving with the weft yarns when the other warp yarn is floating over several weft yarns. The paired warp yarn set may both plain weave adjacent to each other, but do not ever have adjacent floats occurring. Some of weave patterns 10 include instances where the floats may be interrupted with a single, or even twice, by a weave with an underlying weft yarn.

In some instances the floats are nearly reciprocal, in that when one float stops the adjacent warp yarn initiates a float within one weave of a weft yarn. The start and finish of the floats can be plainly seen in the figures. The prompt starting of a float once an adjacent yarn finishes a float is often the case of these inventive weaves.

Adjacent floats, which are the floats that occur adjacent to another float, with one intervening warp yarn between them, have starts and finishes that are offset by one weft yarn, which defines what is referred to herein as a "float offset." By this definition adjacent floats will occur associated among the odd numbered warp yarns or among the even numbered warp yarns, since there will only be plain weaving between them. The float offsets of the starts and the float offsets of the finishes may be in the same direction or different directions. For example, in FIG. 1, the floats that occurs with warp yarns 1 and 3 have the starts and the finishes each offset in the same direction. For the sake of convenience a start can be considered to occur at the lower numbered weft yarn at which the float begins and the finish being the higher number weft yarn where the float ends. So, the float of warp yarn 1 starts with weft yarn 11, and finishes with weft yarn 15. The adjacent float of warp yarn 3 starts with weft yarn 12 and finishes with weft yarn 16, hence the float offset occurs on both the start and finish and the offsets are in the same direction, with the number of the weft yarns both being incremented by one as one goes from warp yarn 1 to warp yarn 3. It should be noted that while each warp yarn float will have an adjacent warp yarn float and will often have one on each side, it is not a requirement that there are two adjacent warp yarn floats offset by one for each warp yarn float.

Figure 26:
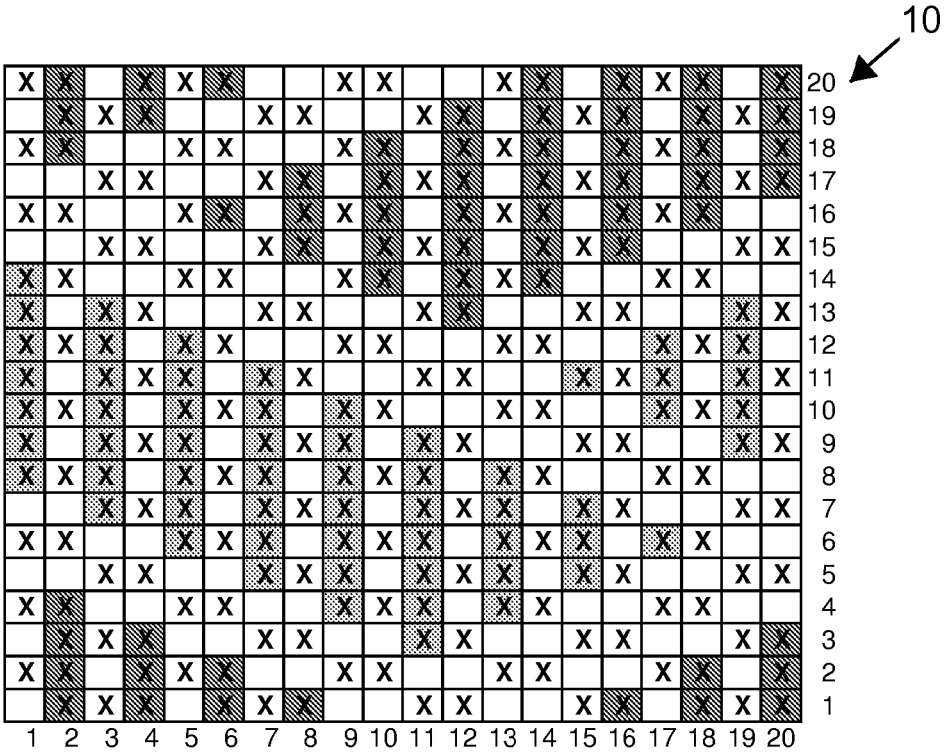
FIG. 26 shows a repeating weave pattern from the top side, or paper facing side, of a still further embodiment of a structured fabric of the present invention, each 'X' indicating a location where a warp yarn passes over a weft yarn.
Figure 27:
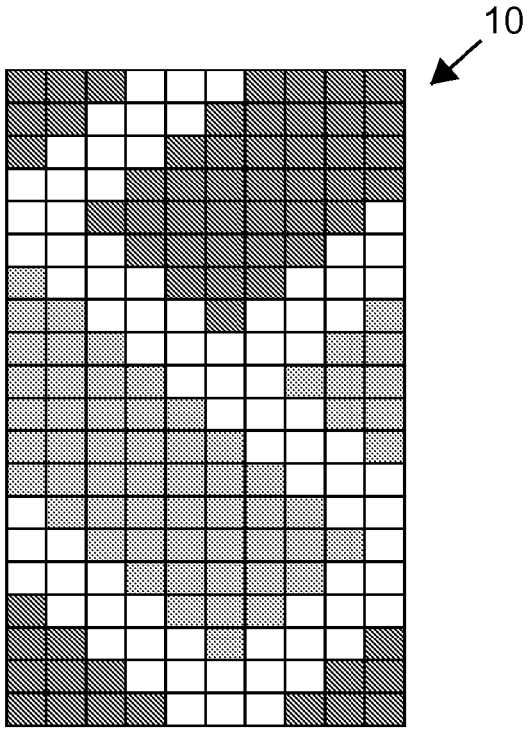
FIG. 27 illustrates a surface motif of the weave pattern of FIG. 26.
Figure 28:
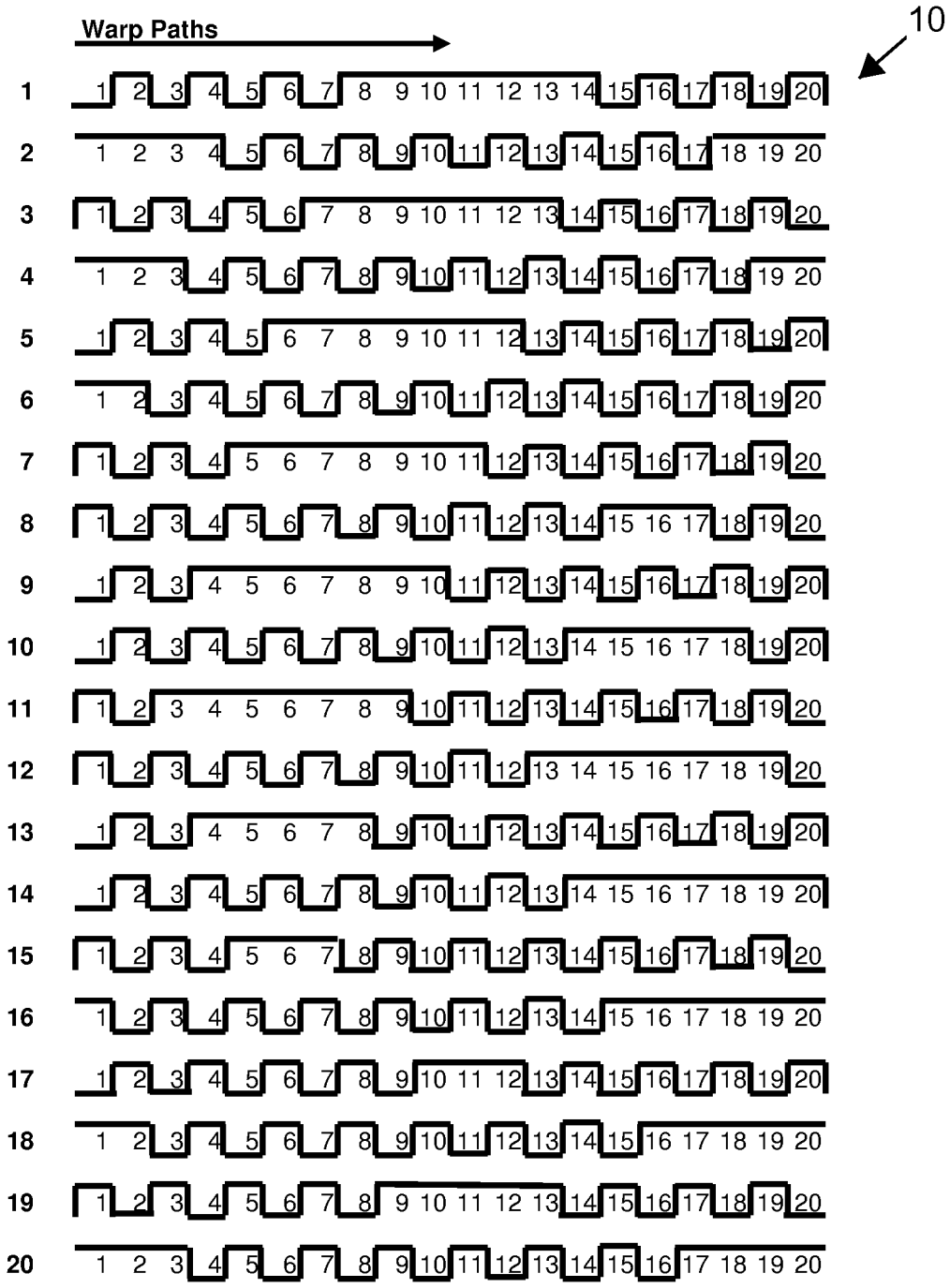
FIG. 28 shows the repeating weave pattern of the warp yarns of the embodiment of FIGS. 26 and 27.
Figure 29:
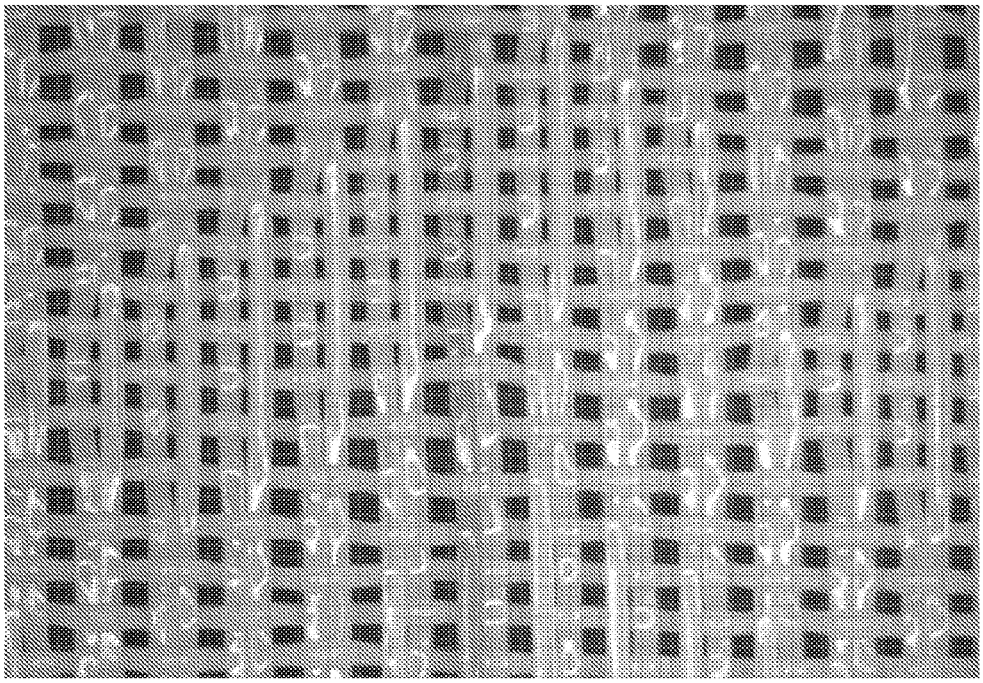
FIG. 29 is an illustration of the structured fabric that results from the weave pattern of FIGS. 26-28.
Figure 30:
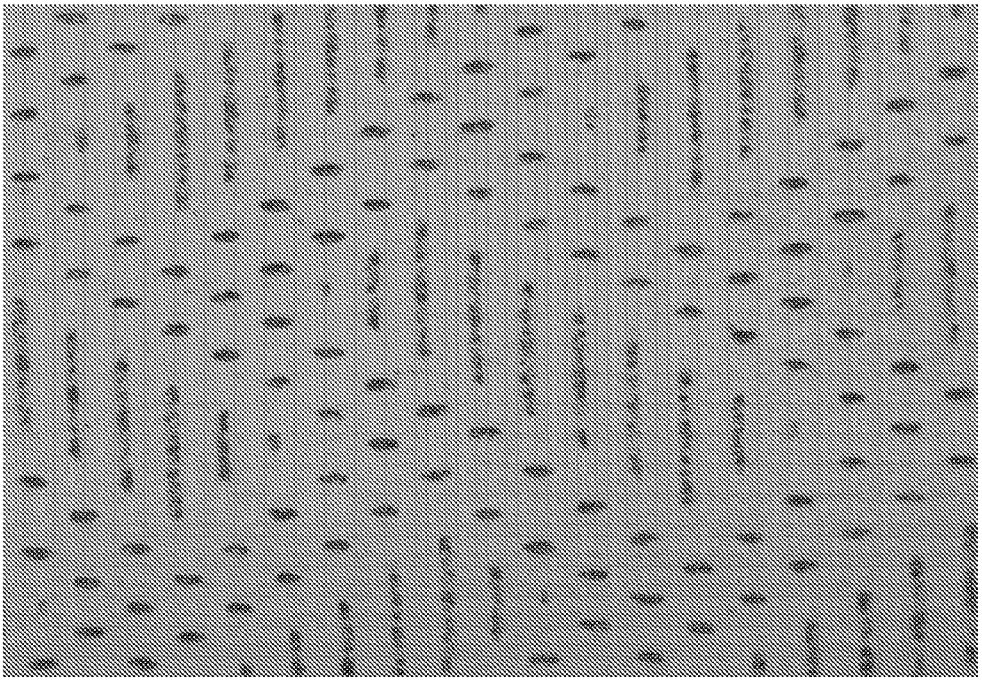
FIG. 30 is an illustration of the impression the structured fabric of FIG. 29 makes on a web.
Figure 31:
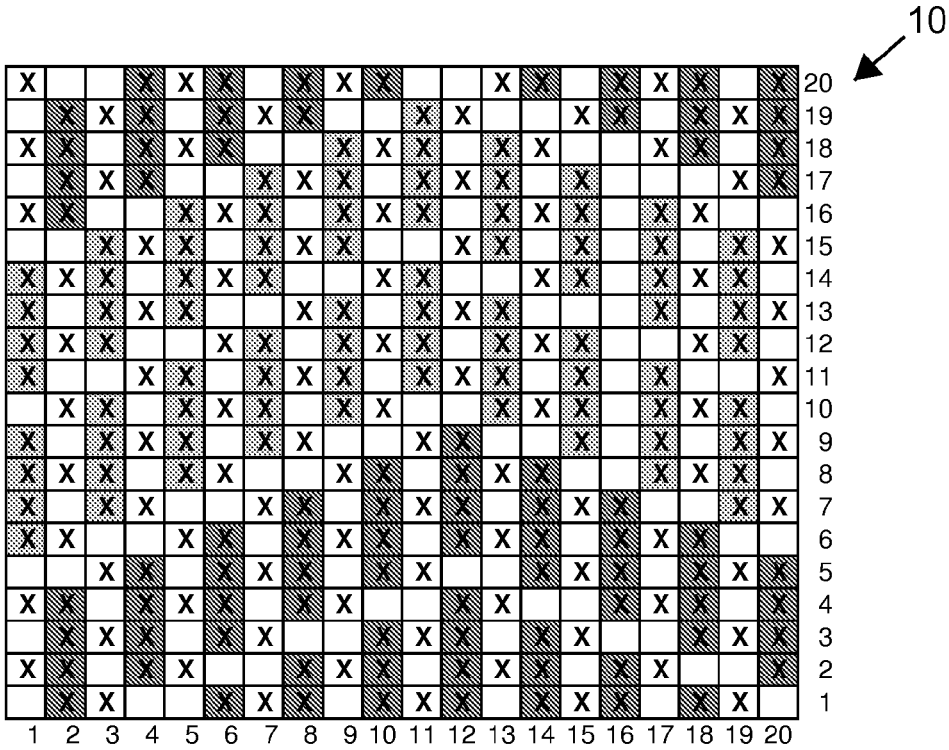
FIG. 31 shows a repeating weave pattern from the top side, or paper facing side, of a further embodiment of a structured fabric of the present invention, each 'X' indicating a location where a warp yarn passes over a weft yarn.
Figure 32:
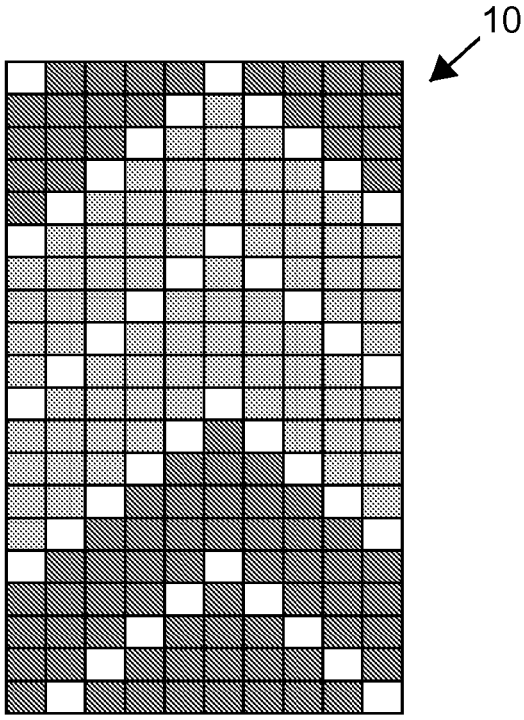
FIG. 32 illustrates a surface motif of the weave pattern of FIG. 31.
Figure 33:
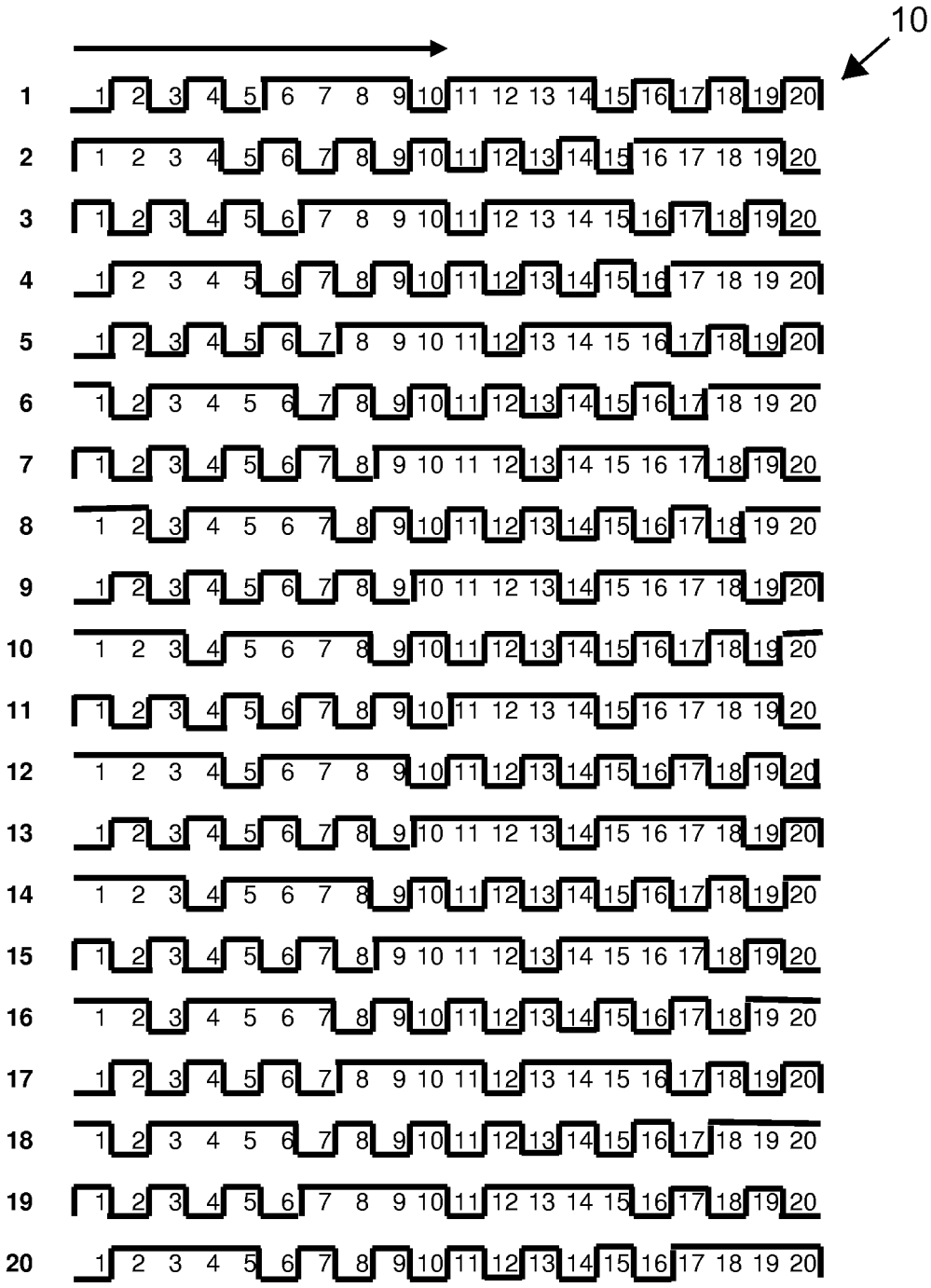
FIG. 33 shows the repeating weave pattern of the warp yarns of the embodiment of FIGS. 31 and 32.
Figure 34:
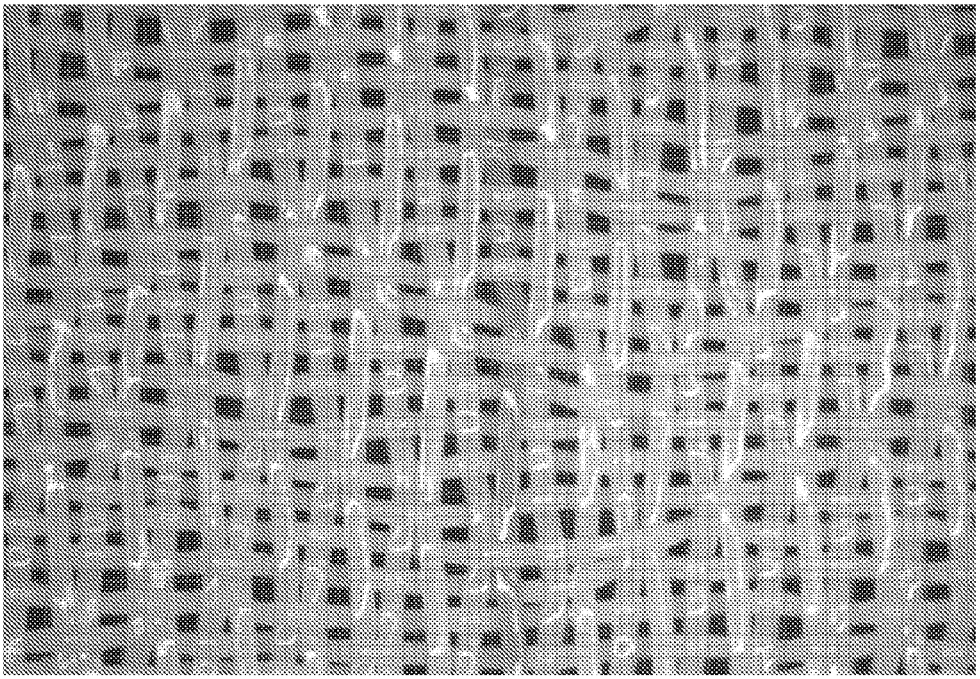
FIG. 34 is an illustration of the structured fabric that results from the weave pattern of FIGS. 31-33.
Figure 35:
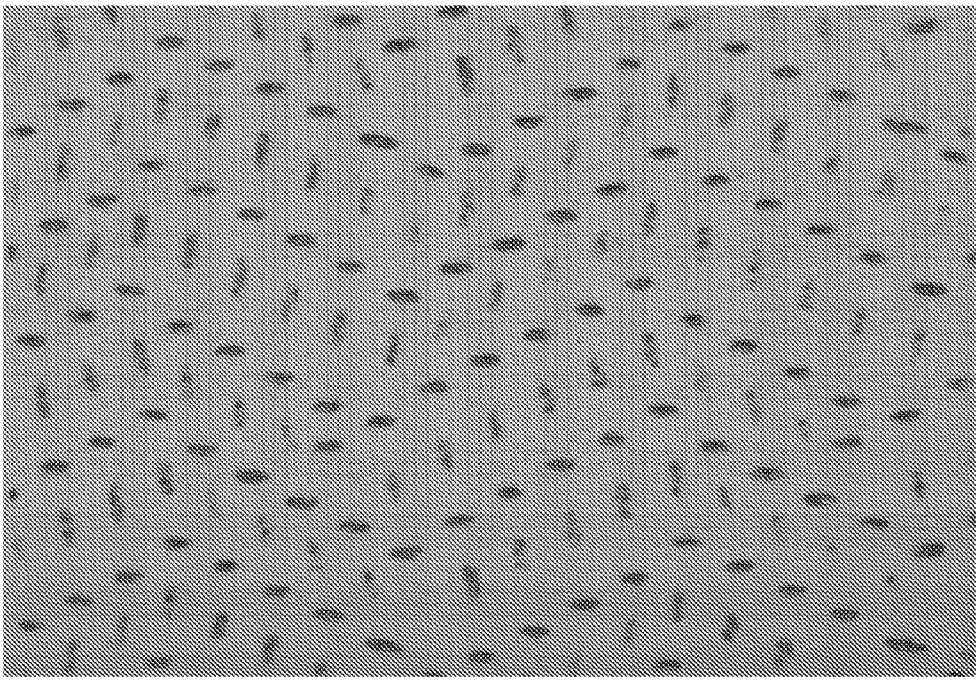
FIG. 35 is an illustration of the impression the structured fabric of FIG. 34 makes on a web.
Figure 36:
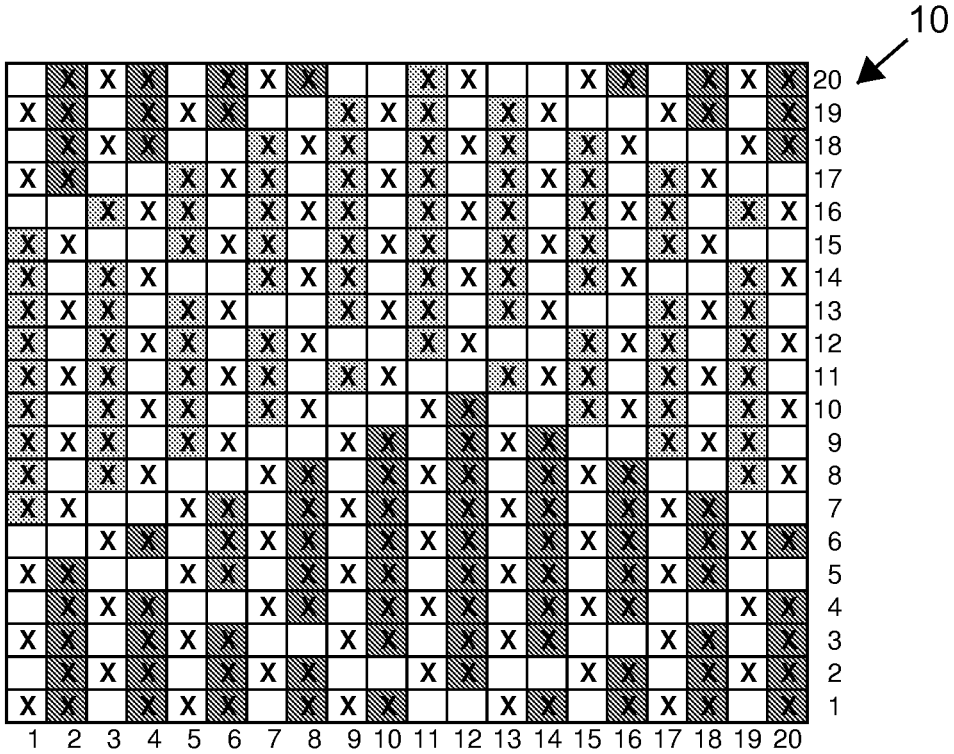
FIG. 36 shows a repeating weave pattern from the top side, or paper facing side, of a still further embodiment of a structured fabric of the present invention, each 'X' indicating a location where a warp yarn passes over a weft yarn.
Figure 37:
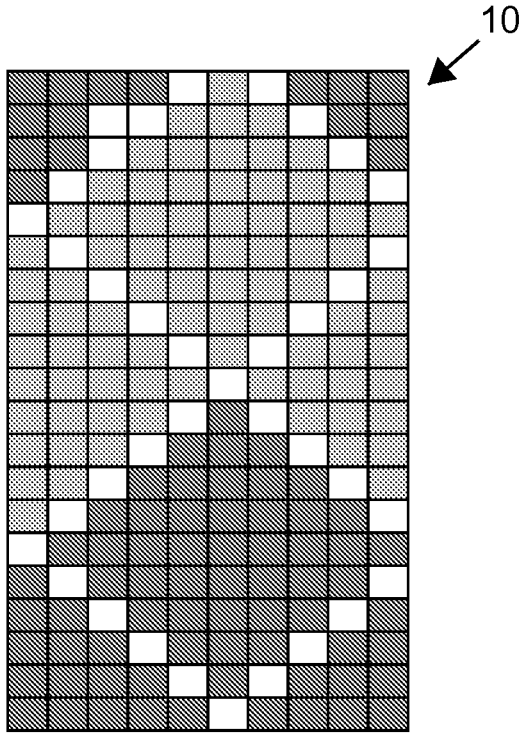
FIG. 37 illustrates a surface motif of the weave pattern of FIG. 36.
Figure 38:
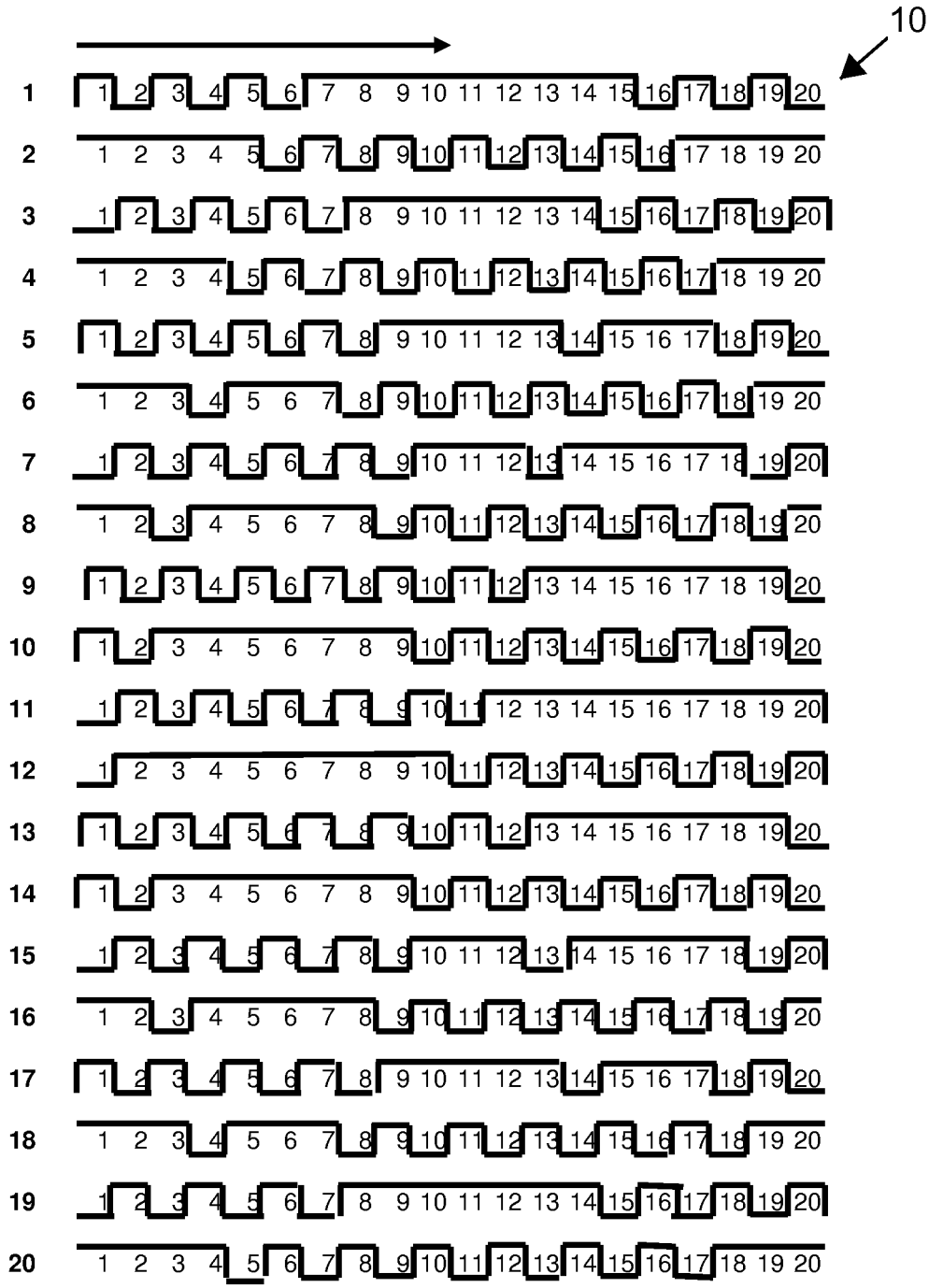
FIG. 38 shows the repeating weave pattern of the warp yarns of the embodiment of FIGS. 36 and 37.
Figure 39:
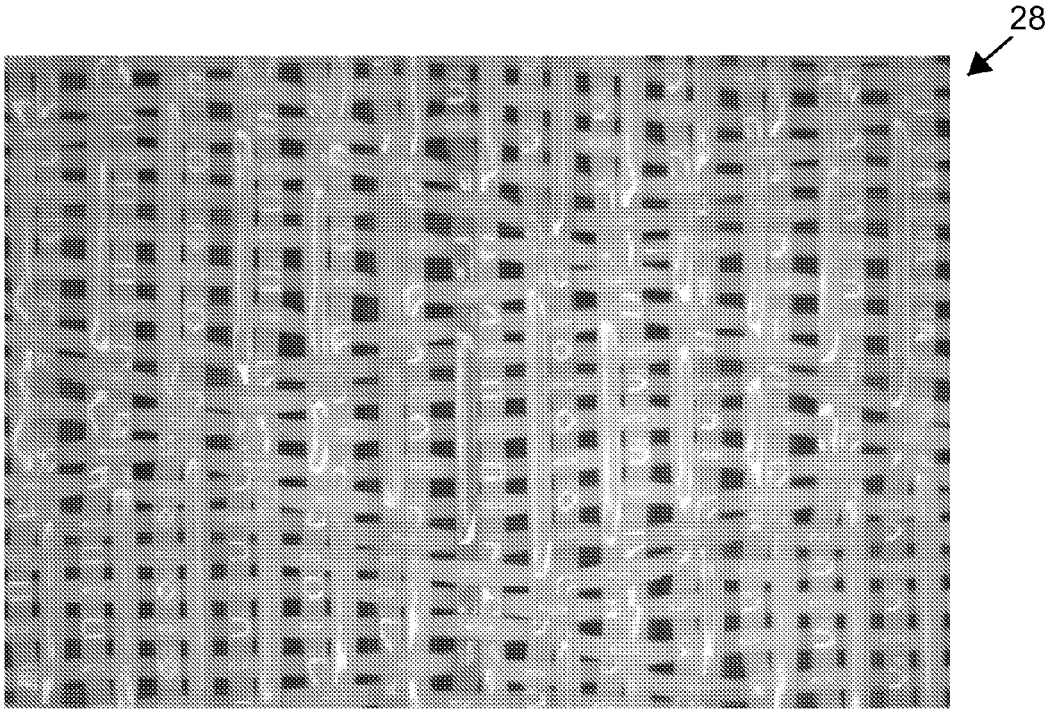
FIG. 39 is an illustration of the structured fabric that results from the weave pattern of FIGS. 36-38.
Figure 40:
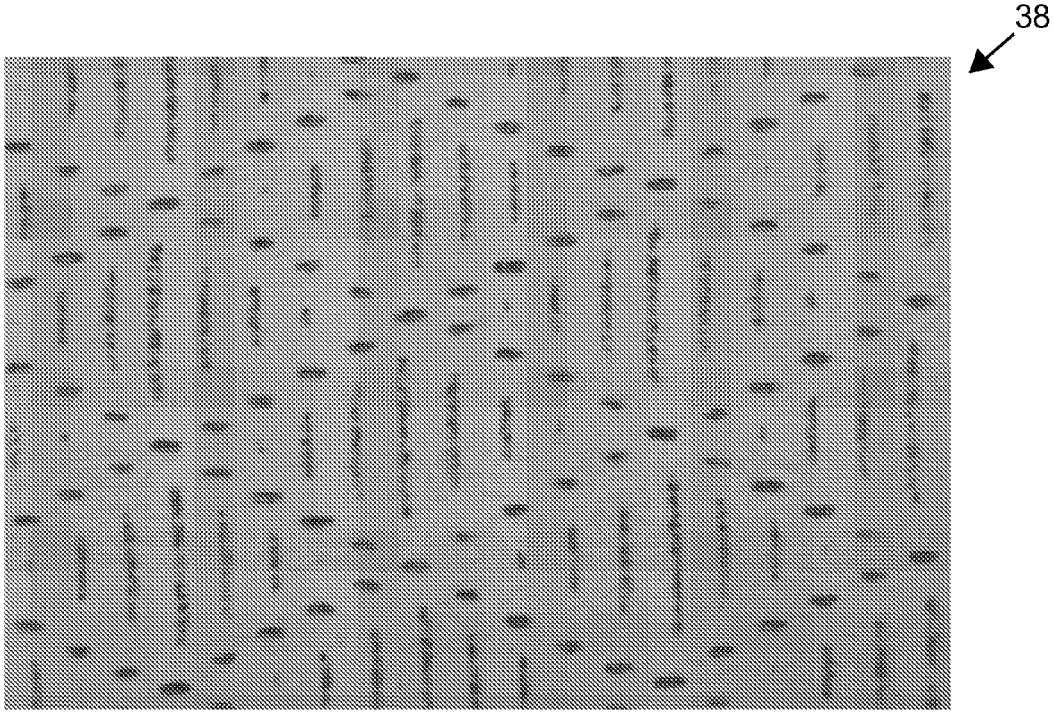
FIG. 40 is an illustration of the impression the structured fabric of FIG. 39 makes on a web.

Looking now at FIG. 26, the float for warp yarn 13 is over 5 weft yarns. The two floats that are adjacent to warp yarn 13, are those that occur for warp yarns 11 and 15, with warp yarn 11 floating over 7 weft yarns, while warp yarn 15 floats over only three weft yarns. In this case the offset of the starts of warp yarns 11 and 13 (wefts 3 and 4) are in one direction and the offset of the finishes (wefts 9 and 8) are in an opposite direction. In a like manner the float of warp yarn 15 that is adjacent to warp yarn 13 have offsets that are in opposite directions.

FIGS. 4, 9, 14, 19, 24, 29, 34 and 39 illustrate the physical weave and how the warp yarns are somewhat paired so that two warp yarns of each pair may be closer together than to another immediately adjacent warp yarn.

Structured fabric 28 can also be treated and/or coated with an additional polymeric material that is applied by, e.g., deposition. The material can be added cross-linked during processing in order to enhance fabric stability, contamination resistance, drainage, wearability, improve heat and/or hydrolysis resistance and in order to reduce fabric surface tension. This aids in sheet release and/or reduced drive loads. The treatment/coating can be applied to impart/improve one or several of these properties of the fabric. As indicated previously, the topographical pattern in the paper web can be changed and manipulated by use of different single-layer weaves. Further enhancement of the pattern can be attained by adjustments to the specific fabric weave by changes to the yarn diameter, yarn counts, yarn types, yarn shapes, permeability, caliper and the addition of a treatment or coating etc. In addition, a printed design, such as a screen-printed design, of polymeric material can be applied to the fabric to enhance its ability to impart an aesthetic pattern into the web or to enhance the quality of the web. Finally, one or more surfaces of the fabric or molding belt can be subjected to sanding and/or abrading in order to enhance surface characteristics.

The characteristics of the individual yarns utilized in the fabric of the present invention can vary depending upon the desired properties of the final papermakers' fabric. For example, the materials comprising yarns employed in the fabric of the present invention may be those commonly used in papermakers' fabric. As such, the yarns may be formed of polypropylene, polyester, nylon, or the like. The skilled artisan should select a yarn material according to the particular application of the final fabric.

By way of non-limiting example, the structured fabric is a single-layered woven fabric which can withstand high pressures, heat, moisture concentrations, and which can achieve a high level of water removal and also mold or emboss the paper web. These characteristics provide a structured fabric appropriate for the Voith ATMOS™ papermaking process. The fabric preferably has a width stability and a suitable high permeability and preferably utilizes hydrolysis and/or temperature resistant materials, as discussed above. The fabric is preferably a woven fabric that can be installed on an ATMOS™ machine as a pre-joined and/or seamed continuous and/or endless belt. Alternatively, the structured fabric can be joined in the ATMOS™ machine using, e.g., a pin-seam arrangement or can otherwise be seamed on the machine.

The invention also provides for utilizing the structured fabric disclosed herein on a machine for making a fibrous web, e.g., tissue or hygiene paper web, etc., which can be, e.g., a twin wire or a permeable belt ATMOS™ system. Referring again to the drawings, and more particularly to FIGS. 41-47, there is a fibrous web machine including a headbox 22 that discharges a fibrous slurry between a forming fabric 26 and a structured fabric 28 having a weave pattern 10. It should be understood that structured fabric 28 is an embodiment of the structured fabric discussed above in connection with FIGS. 1-28. Rollers 30 and 32 direct fabric 26 in such a manner that tension is applied thereto, against slurry 24 and structured fabric 28. Structured fabric 28 is supported by forming roll 34 which rotates with a surface speed that matches the speed of structured fabric 28 and forming fabric 26. Structured fabric 28 has peaks and valleys as defined by weave pattern 10, which give a corresponding structure to web 38 formed thereon. Structured fabric 28 travels in a web direction, and as moisture is driven from the fibrous slurry, structured fibrous web 38 takes form. The moisture that leaves the slurry travels through forming fabric 26.

The fibrous slurry is formed into a web 38 with a structure that matches the shape of structured fabric 28. Forming fabric 26 is porous and allows moisture to escape during forming. Further, water is removed through dewatering fabric 82. The removal of moisture through fabric 82 does not cause compression of web 38 traveling on structured fabric 28.

Due to the formation of the web 38 with the structured fabric 28 the pockets of the fabric 28 are fully filled with fibers. Therefore, at the Yankee surface 52 the web 38 has a much higher contact area, up to approximately 100%, as compared to the prior art because the web 38 on the side contacting the Yankee surface 52 is almost flat.

Figure 41:
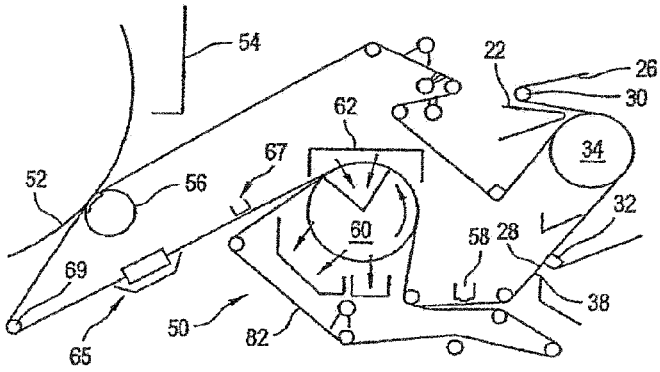
FIG. 41 illustrates a schematic cross-sectional view of an embodiment of an ATMOS™ papermaking machine.

Referring to FIG. 41, there is shown an embodiment of the process where a structured fibrous web 38 is formed. Structured fabric 28 carries a three dimensional structured fibrous web 38 to an advanced dewatering system 50, past vacuum box 67 and then to a position where the web is transferred to Yankee dryer 52 and hood section 54 for additional drying and creping before winding up on a reel (not shown).

A shoe press 56 is placed adjacent to structured fabric 28, holding fabric 28 in a position proximate Yankee dryer 52. Structured fibrous web 38 comes into contact with Yankee dryer 52 and transfers to a surface thereof, for further drying and subsequent creping.

A vacuum box 58 is placed adjacent to structured fabric 28 to achieve improved solids levels. Web 38, which is carried by structured fabric 28, contacts dewatering fabric 82 and proceeds toward vacuum roll 60. Vacuum roll 60 operates at a vacuum level of −0.2 to −0.8 bar with a preferred operating level of at least −0.4 bar. Hot air hood 62 is optionally fit over vacuum roll 60 to improve dewatering.

Optionally a steam box can be installed instead of the hood 62 supplying steam to the web 38. The steam box preferably has a sectionalized design to influence the moisture re-dryness cross profile of the web 38. The length of the vacuum zone inside the vacuum roll 60 can be from 200 mm to 2,500 mm, with a preferable length of 300 mm to 1,200 mm and an even more preferable length of between 400 mm to 800 mm. The solids level of web 38 leaving suction roll 60 is 25% to 55% depending on installed options. A vacuum box 67 and hot air supply 65 can be used to increase web 38 solids after vacuum roll 60 and prior to Yankee dryer 52. Wire turning roll 69 can also be a suction roll with a hot air supply hood. As discussed above, roll 56 includes a shoe press with a shoe width of 80 mm or higher, preferably 120 mm or higher, with a maximum peak pressure of less than 2.5 MPa. To create an even longer nip to facilitate the transfer of web 38 to Yankee dryer 52, web 38 carried on structured fabric 28 can be brought into contact with the surface of Yankee dryer 52 prior to the press nip associated with shoe press 56. Further, the contact can be maintained after structured fabric 28 travels beyond press 56.

Figure 42:
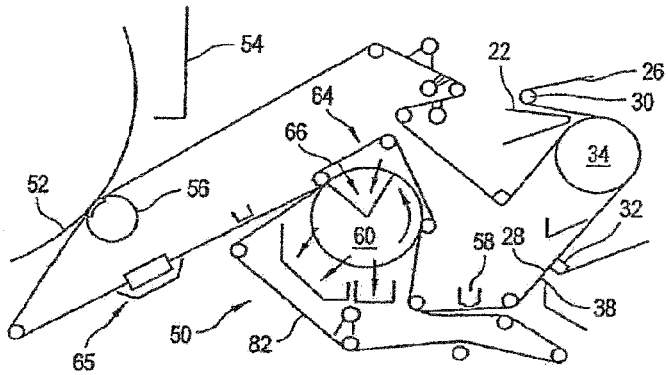
FIG. 42 illustrates a schematic cross-sectional view of another embodiment of an ATMOS™ papermaking machine.

Now, additionally referring to FIG. 42, there is shown yet another embodiment of the present invention, which is substantially similar to the invention illustrated in FIG. 41, except that instead of hot air hood 62, there is a belt press 64. Belt press 64 includes a permeable belt 66 capable of applying pressure to the machine side of structured fabric 28 that carries web 38 around vacuum roll 60. Fabric 66 of belt press 64 is also known as an extended nip press belt or a link fabric, which can run at 60 KN/m fabric tension with a pressing length that is longer than the suction zone of roll 60.

Preferred embodiments of the fabric 66 and the required operation conditions are also described in PCT/EP2004/053688 and PCT/EP2005/050198 which are herewith incorporated by reference.

The above mentioned references are also fully applicable for dewatering fabrics 82 and press fabrics 66 described in the further embodiments.

Belt 66 is a specially designed extended nip press belt 66, made of, for example reinforced polyurethane and/or a spiral link fabric. Belt 66 also can have a woven construction. Such a woven construction is disclosed, e.g., in EP 1837439. Belt 66 is permeable thereby allowing air to flow there through to enhance the moisture removing capability of belt press 64. Moisture is drawn from web 38 through dewatering fabric 82 and into vacuum roll 60.

Figure 43:
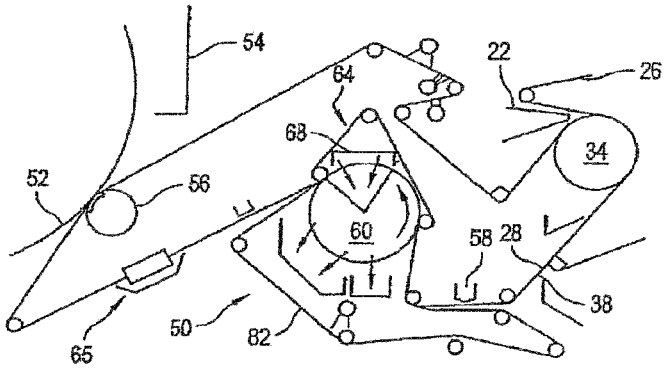
FIG. 43 illustrates a schematic cross-sectional view of another embodiment of an ATMOS™ papermaking machine.

Referring to FIG. 43, there is shown another embodiment of the present invention which is substantially similar to the embodiment shown in FIG. 42 with the addition of hot air hood 68 placed inside of belt press 64 to enhance the dewatering capability of belt press 64 in conjunction with vacuum roll 60.

Figure 44:
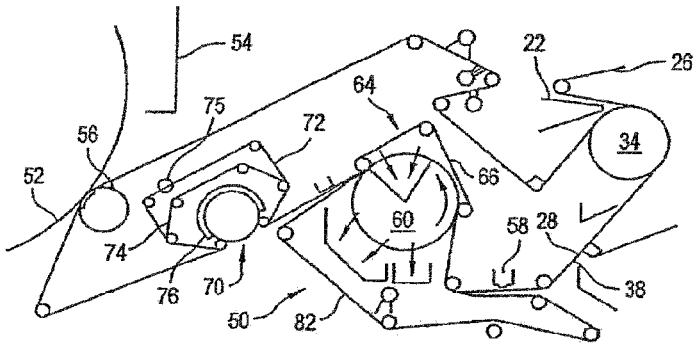
FIG. 44 illustrates a schematic cross-sectional view of another embodiment of an ATMOS™ papermaking machine.

Referring to FIG. 44, there is shown yet another embodiment of the present invention, which is substantially similar to the embodiment shown in FIG. 42, but including a boost dryer 70 which encounters structured fabric 28. Web 38 is subjected to a hot surface of boost dryer 70, and structured web 38 rides around boost dryer 70 with another woven fabric 72 riding on top of structured fabric 28. On top of woven fabric 72 is a thermally conductive fabric 74, which is in contact with both woven fabric 72 and a cooling jacket 76 that applies cooling and pressure to all fabrics and web 38. The pressing process does not negatively impact web quality. The drying rate of boost dryer 70 is above 400 kg/hr $m^2$ and preferably above 500 kg/hr $m^2$. The concept of boost dryer 70 is to provide sufficient pressure to hold web 38 against the hot surface of the dryer thus preventing blistering. Steam that is formed at the knuckle points of fabric 28 passes through fabric 28 and is condensed on fabric 72. Fabric 72 is cooled by fabric 74 that is in contact with cooling jacket 76, which reduces its temperature to well below that of the steam. Thus the steam is condensed to avoid a pressure build up to thereby avoid blistering of web 38. The condensed water is captured in woven fabric 72, which is dewatered by dewatering device 75. It has been shown that depending on the size of boost dryer 70, the need for vacuum roll 60 can be eliminated. Further, depending on the size of boost dryer 70, web 38 may be creped on the surface of boost dryer 70, thereby eliminating the need for Yankee dryer 52.

Figure 45:
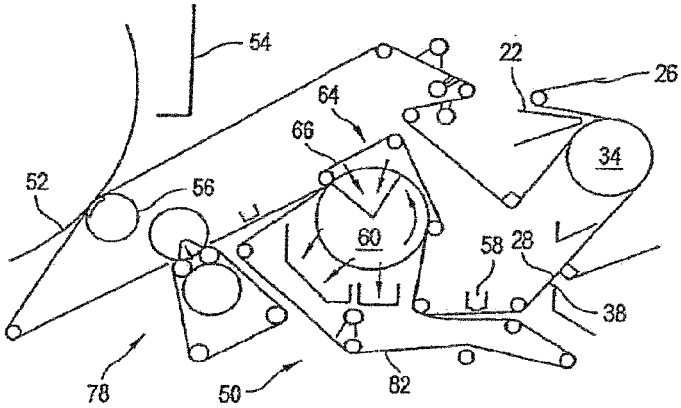
FIG. 45 illustrates a schematic cross-sectional view of another embodiment of an ATMOS™ papermaking machine.

Referring to FIG. 45, there is shown yet another embodiment of the present invention substantially similar to the invention disclosed in FIG. 42 but with an addition of an air press 78, which is a four roll cluster press that is used with high temperature air and is referred to as a High Pressure Through Air Dryer (HPTAD) for additional web drying prior to the transfer of web 38 to Yankee dryer 52. Four-roll cluster press 78 includes a main roll, a vented roll, and two cap rolls. The purpose of this cluster press is to provide a sealed chamber that is capable of being pressurized. The pressure chamber contains high temperature air, for example, 150° C. or higher and is at a significantly higher pressure than conventional TAD technology, for example, greater than 1.5 psi resulting in a much higher drying rate than a conventional TAD. The high-pressure hot air passes through an optional air dispersion fabric, through web 38 and fabric structured 28 into a vent roll. The air dispersion fabric may prevent web 38 from following one of the cap rolls. The air dispersion fabric is very open, having a permeability that equals or exceeds that of fabric structured 28. The drying rate of the HPTAD depends on the solids content of web 38 as it enters the HPTAD. The preferred drying rate is at least 500 kg/hr $m^2$, which is a rate of at least twice that of conventional TAD machines.

Advantages of the HPTAD process are in the areas of improved sheet dewatering without a significant loss in sheet quality and compactness in size and energy efficiency. Additionally, it enables higher pre-Yankee solids, which increase the speed potential of the invention. Further, the compact size of the HPTAD allows for easy retrofitting to an existing machine. The compact size of the HPTAD and the fact that it is a closed system means that it can be easily insulated and optimized as a unit to increase energy efficiency.

Figure 46:
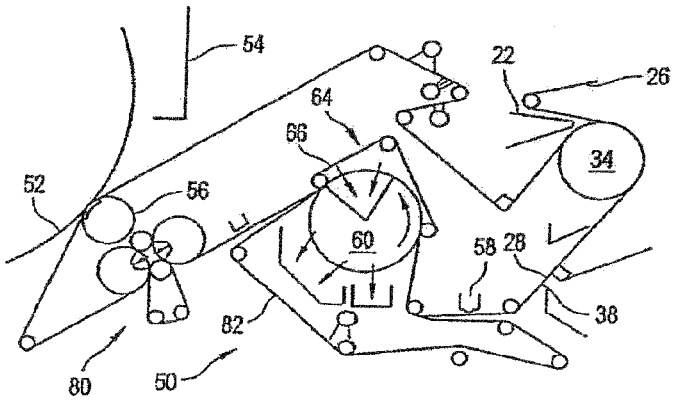
FIG. 46 illustrates a schematic cross-sectional view of another embodiment of an ATMOS™ papermaking machine.

Referring to FIG. 46, there is shown another embodiment of the present invention. This is significantly similar to the embodiments shown in FIGS. 42 and 45 except for the addition of a two-pass HPTAD 80. In this case, two vented rolls are used to double the dwell time of structured web 38 relative to the design shown in FIG. 45. An optional coarse mesh fabric may be used as in the previous embodiment. Hot pressurized air passes through web 38 carried on structured fabric 28 and onto the two vent rolls. It has been shown that depending on the configuration and size of the HPTAD, more than one HPTAD can be placed in series, which can eliminate the need for roll 60.

Figure 47:
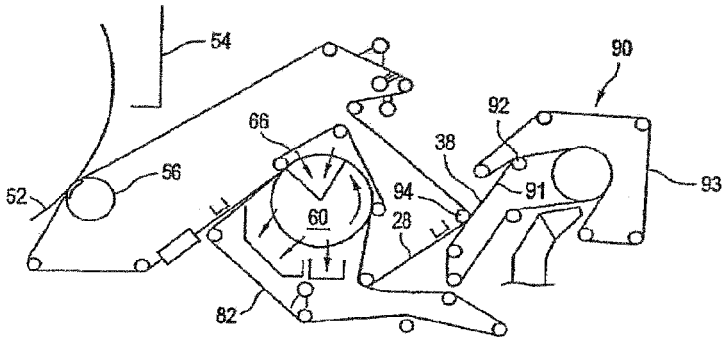
FIG. 47 illustrates a schematic cross-sectional view of another embodiment of an ATMOS™ papermaking machine.

Referring to FIG. 47, a conventional twin wire former 90 may be used to replace the crescent former shown in previous examples. The forming roll can be either a solid or open roll. If an open roll is used, care must be taken to prevent significant dewatering through the structured fabric to avoid losing basis weight in the pillow areas. The outer forming fabric 93 can be either a standard forming fabric or one such as that disclosed in U.S. Pat. No. 6,237,644. The inner fabric 91 should be a structured fabric that is much coarser than the outer forming fabric 90. For example, inner fabric 91 may be similar to structured fabric 28. A vacuum roll 92 may be needed to ensure that the web stays with structured fabric 91 and does not go with outer wire 90. Web 38 is transferred to structured fabric 28 using a vacuum device. The transfer can be a stationary vacuum shoe or a vacuum assisted rotating pick-up roll 94. The second structured fabric 28 is at least the same coarseness and preferably coarser than first structured fabric 91. The process from this point is the same as the process previously discussed in conjunction with FIG. 42. The registration of the web from the first structured fabric to the second structured fabric is not perfect, and as such some pillows will lose some basis weight during the expansion process, thereby losing some of the benefit of the present invention. However, this process option allows for running a differential speed transfer, which has been shown to improve some sheet properties. Any of the arrangements for removing water discussed above as may be used with the twin wire former arrangement and a conventional TAD.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A papermaking machine for the production of a fibrous web, the papermaking machine, comprising:

a plurality of rollers; and a structured fabric moving along said plurality of rollers, said structured fabric including:

a plurality of weft yarns; and a plurality of warp yarns woven with said plurality of weft yarns to produce a weave pattern, said plurality of warp yarns being a plurality of paired warp yarn sets, each paired warp yarn set including a first warp yarn and a second warp yarn, within said weave pattern said first warp yarn weaving a plain weave while said second warp yarn floats over a first portion of said plurality of weft yarns, said second warp yarn weaving a plain weave while said first warp yarn floats over a second portion of said plurality of weft yarns in said weave pattern, said plurality of pair warp yarn sets include a first warp yarn set and a second warp yarn set immediately adjacent to said first warp yarn set, said first warp yarn and said second warp yarn of both said first warp yarn set and said second warp yarn set being closer to each other than said second warp yarn of said first warp yarn set is to said first warp yarn of said second warp yarn set.

2. The papermaking machine of claim 1, wherein at least some floats of some of said paired warp yarn sets have the float interrupted with a single weave with one of said plurality of weft yarns.

3. The papermaking machine of claim 1, wherein said second portion is substantially all of said plurality of weft yarns in said weave pattern except for said weft yarns included in said first portion.

4. The papermaking machine of claim 1, wherein said float of said first yarn of each paired warp yarn set has a start and a finish, said start of each first yarn being offset by one weft yarn for said first yarn in an adjacent paired warp yarn set.

5. The papermaking machine of claim 4, wherein said finish of each first yarn is offset by one weft yarn for said first yarn in an adjacent paired warp yarn set.

6. The papermaking machine of claim 5, wherein said offset of said start and said offset of said finish are in a same direction.

7. The papermaking machine of claim 5, wherein said offset of said start and said offset of said finish are in a different direction.

8. The papermaking machine of claim 5, wherein said second yarn weaves in a plain manner at said offset of said start and at said offset of said finish.

9. A structured fabric for use with a papermaking machine for the production of a fibrous web, the structured fabric, comprising:

a plurality of weft yarns; and a plurality of warp yarns woven with said plurality of weft yarns to produce a weave pattern, said plurality of warp yarns being a plurality of paired warp yarn sets, each paired warp yarn set including a first warp yarn and a second warp yarn, within said weave pattern said first warp yarn weaving a plain weave while said second warp yarn floats over a first portion of said plurality of weft yarns, said second warp yarn weaving a plain weave while said first warp yarn floats over a second portion of said plurality of weft yarns in said weave pattern, said plurality of pair warp yarn sets include a first warp yarn set and a second warp yarn set immediately adjacent to said first warp yarn set, said first warp yarn and said second warp yarn of both said first warp yarn set and said second warp yarn set being closer to each other than said second warp yarn of said first warp yarn set is to said first warp yarn of said second warp yarn set.

10. The structured fabric of claim 9, wherein at least some floats of some of said paired warp yarn sets have the float interrupted with a single weave with one of said plurality of weft yarns.

11. The structured fabric of claim 9, wherein said second portion is substantially all of said plurality of weft yarns in said weave pattern except for said weft yarns included in said first portion.

12. The structured fabric of claim 9, wherein said float of said first yarn of each paired warp yarn set has a start and a finish, said start of each first yarn being offset by one weft yarn for said first yarn in an adjacent paired warp yarn set.

13. The structured fabric of claim 12, wherein said finish of each first yarn is offset by one weft yarn for said first yarn in an adjacent paired warp yarn set.

14. The structured fabric of claim 13, wherein said offset of said start and said offset of said finish are in a same direction.

15. The structured fabric of claim 13, wherein said offset of said start and said offset of said finish are in a different direction.

16. The structured fabric of claim 13, wherein said second yarn weaves in a plain manner at said offset of said start and at said offset of said finish.

17. A fibrous web, comprising:

a fibrous construct having at least one formed surface feature, said surface feature including a topographical pattern reflective of a weave pattern in a fabric used in a papermaking machine, the fabric including:

a plurality of weft yarns; and a plurality of warp yarns woven with said plurality of weft yarns to produce said weave pattern, said plurality of warp yarns being a plurality of paired warp yarn sets, each paired warp yarn set including a first warp yarn and a second warp yarn, within said weave pattern said first warp yarn weaving a plain weave while said second warp yarn floats over a first portion of said plurality of weft yarns, said second warp yarn weaving a plain weave while said first warp yarn floats over a second portion of said plurality of weft yarns in said weave pattern, said plurality of pair warp yarn sets include a first warp yarn set and a second warp yarn set immediately adjacent to said first warp yarn set, said first warp yarn and said second warp yarn of both said first warp yarn set and said second warp yarn set being closer to each other than said second warp yarn of said first warp yarn set is to said first warp yarn of said second warp yarn set.

18. The fibrous web of claim 17, wherein said second portion of said structured fabric is substantially all of said plurality of weft yarns in said weave pattern except for said weft yarns included in said first portion.

* * * * *